US009704406B1

(12) United States Patent
Young et al.

(10) Patent No.: US 9,704,406 B1
(45) Date of Patent: Jul. 11, 2017

(54) ACCURATE DETERMINATION OF INTENDED GROUND TRACK WITH FLIGHT MANAGEMENT SYSTEM DEVICE AND METHOD

(71) Applicant: Rockwell Collins, Inc., Cedar Rapids, IA (US)

(72) Inventors: Shih-Yih Young, Marion, IA (US); Kristen M. Jerome, Monticello, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 0 days.

(21) Appl. No.: 15/064,053

(22) Filed: Mar. 8, 2016

(51) Int. Cl.
*G08G 5/00* (2006.01)

(52) U.S. Cl.
CPC ..... *G08G 5/0039* (2013.01); *G08G 5/0047* (2013.01)

(58) Field of Classification Search
CPC .... G08G 5/003; G08G 5/0034; G08G 5/0039; G08G 5/0047
See application file for complete search history.

(56) References Cited

U.S. PATENT DOCUMENTS 6,134,500 A * 10/2000 Tang ..... G05D 1/0005 701/10
6,163,744 A * 12/2000 Onken ..... G01C 23/00 340/979
6,314,362 B1 * 11/2001 Erzberger ..... G08G 5/0043 340/961
6,571,171 B1 * 5/2003 Pauly ..... G01C 23/00 244/175
7,650,232 B1 * 1/2010 Paielli ..... G01C 23/005 340/963
8,744,747 B1 * 6/2014 Bailey ..... G01C 21/20 701/408
2005/0004723 A1 * 1/2005 Duggan ..... G05D 1/0061 701/24
2008/0177431 A1 * 7/2008 Coulmeau ..... G05D 1/101 701/15
2009/0055035 A1 * 2/2009 Caillaud ..... G01C 21/00 701/5

(Continued)

OTHER PUBLICATIONS

Flightradar24, "Flight Paths and Great Circles—or Why You Flew Over Greenland", May 5, 2015 Blog Entry, 4 pages, downloaded from: https://www.flightradar24.com/blog/flight-paths-and-great-circles-or-why-you-flew-over-greenland/.*

(Continued)

*Primary Examiner* — Behrang Badii
*Assistant Examiner* — David Testardi
(74) *Attorney, Agent, or Firm* — Angel N. Gerdzhikov; Donna P. Suchy; Daniel M. Barbieri

(57) ABSTRACT

A flight management system device and method. The method includes determining a ground track for a flight leg based on a spherical earth model. The flight leg includes two waypoints that are specified with an ellipsoidal earth model. The method includes determining that a parameter associated with the ground track exceeds a threshold. The method includes inserting an anchor point between the two waypoints on a geodesic to effect a course change to the ground track between the two waypoints such that an intended flight path is within specified thresholds. The geodesic is associated with the ellipsoidal earth model. The method includes modifying the ground track to include two spherical earth model path segments spanning from the first waypoint through the anchor point to the second waypoint. The two spherical earth model path segments are computed based on the spherical earth model. The method includes storing modified ground track data.

20 Claims, 21 Drawing Sheets

(56) References Cited

U.S. PATENT DOCUMENTS

| | | | | |
|---|---|---|---|---|
| 2010/0211302 | A1* | 8/2010 | Ribbe | G08G 5/0039 701/120 |
| 2012/0116614 | A1* | 5/2012 | Torres | G08G 5/0013 701/3 |
| 2012/0209515 | A1* | 8/2012 | Klooster | G08G 5/0013 701/439 |
| 2016/0012733 | A1* | 1/2016 | Girardeau | G08G 5/0039 701/529 |
| 2016/0026178 | A1* | 1/2016 | Berrajaa | G05D 1/00 701/467 |
| 2016/0147224 | A1* | 5/2016 | Roger | G05D 1/0077 701/3 |

OTHER PUBLICATIONS

Lankford, David N. et al., "Analysis of RNP Maximum Route Length", FAA Technical Report DOT-FAA-AFS-420-92, Apr. 2003, 25 pages.*

Tarbert, Bruce, "Area Navigation (RNAV) and Required Navigation Performance (RNP), Program Overview", FAA CDA Workshop, Jan. 19, 2006, 17 pages.*

Walter, Randy, "Flight management systems", from Chapter 15 in Cary R. Spitzer, editor, "Digital Aviation Handbook, Second Edition", CRC Press 2000 (Copyright 2001), 25 pages.*

Wikipedia, "Flight management system", Old revision dated Aug. 7, 2015, 5 pages.*

FAA, Approval Guidance for RNP Operations and Barometric Vertical Navigation in the U.S. National Airspace System, Advisory Circular (AC) 90-105, Jan. 23, 2009, 39 pages.

FAA, Approval Guidance for RNP Procedures with AR, Advisory Circular (AC) 90-101A, Feb. 23, 2011, 43 pages.

FAA, United States Standard for Performance Based Navigation (PBN) Instrument Procedure Design, Order 8260.58, Sep. 21, 2012, 294 pages.

RTCA, Minimum Aviation System Performance Standards: Required Navigation Performance for Area Navigation, DO-236C, prepared SC-227, Jun. 19, 2013, 152 pages, ©2013, RTCA, Inc., Washington, D.C.

* cited by examiner

| | |
|---|---|
| ☆ | WAYPOINT IN ACTIVE FLIGHT PLAN |
| △ | INTERNAL ANCHOR POINT |
| —— | GEODESIC ON THE WGS-84 ELLIPSOIDAL MODEL |
| $\varphi_1^e$ | STARTING AZIMUTH ON AN ELLIPSOID |
| $\varphi_3^e$ | ENDING AZIMUTH ON AN ELLIPSOID |
| $O^e$ | GEODETIC TURN CANTER AS CENTER OF THE ELLIPSOIDAL ARC |
| R | ARC RADIUS |

| | |
|---|---|
| ——— | PATH ON THE WGS-84 ELLIPSOIDAL MODEL |
| — — | PATH ON A SPHERICAL MODEL |
| R | DISTANCE ON THE SURFACE OF THE GIVEN EARTH MODEL |
| $O^e$ | GEODETIC TURN CENTER FOR BOTH CURVED PATH SEGMENTS |
| $O_1^s$ | SPHERICAL TURN CENTER FOR PATH FROM E1 TO E2 |
| $O_2^s$ | SPHERICAL TURN CENTER FOR PATH FROM E2 TO E3 |

| | |
|---|---|
| ☆ | WAYPOINT IN ACTIVE FLIGHT PLAN |
| △ | INTERNAL ANCHOR POINT |
| —— | GEODESIC ON THE WGS-84 ELLIPSOIDAL MODEL |
| ..... | PATH ON THE SPHERICAL EARTH MODEL |
| $\varphi^s_1$ | STARTING AZIMUTH ON A SPHERE |
| $\varphi^s_3$ | ENDING AZIMUTH ON A SPHERE |
| $O^e$ | GEODETIC TURN CANTER AS CENTER OF THE ELLIPSOIDAL ARC |
| R | ARC RADIUS |

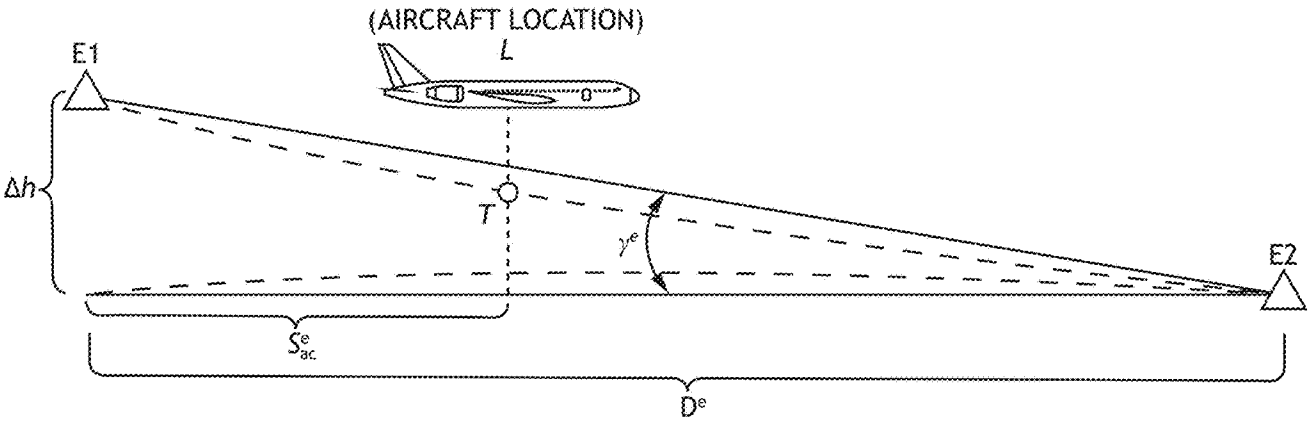

| △ | INTERNAL ANCHOR POINT |
|---|---|
| —— | GEODESIC ON THE WGS-84 ELLIPSOIDAL MODEL |
| – – | PATH ON A SPHERICAL MODEL |
| $D^e$ | PATH LENGTH ON THE WGS-84 ELLIPSOIDAL MODEL |
| $\Delta h$ | ALTITUDE CHANGE BETWEEN TWO SUCCESSIVE ANCHOR POINTS |

| $\tan \gamma^e$ | $\frac{\Delta h}{D^e}$ |
|---|---|
| $S^e_{ac}$ | GEODESIC BETWEEN AIRCRAFT AND THE BEGINNING ANCHOR POINT ON THE WGS-84 ELLIPSOIDAL MODEL |
| E1&E2 | ANCHOR POINTS DEFINING THE DESCENT PATH SEGMENT |

FIG. 20

ACCURATE DETERMINATION OF INTENDED GROUND TRACK WITH FLIGHT MANAGEMENT SYSTEM DEVICE AND METHOD

BACKGROUND

An intended ground track of an aircraft may be calculated as a geodesic curve (or simply as a geodesic) that is a path with the shortest distance between two locations on the surface of a given earth model. The length of the geodesic curve is measured along the surface of the given earth model, as is defined for the ground track of an aircraft. A two-dimensional (sometimes referred to as "2D" or "2-D") geodesic is a straight line.

Regulatory documents have contemplated mandates that geodesic curves are to be based on an ellipsoidal earth model that is defined by the World Geodetic System 84 (WGS-84) coordinate system, instead of a spherical earth model that is currently used by some flight management system (FMS) products.

The Federal Aviation Administration's (FAA's) Next Generation Air Transportation Modernization (sometimes referred to as "NextGen") program and the Single European Sky Air Traffic Management (ATM) Research (SESAR) program require a four-dimensional (sometimes referred to as "4D" or "4-D"; e.g., three spatial dimensions and a time dimension) trajectory architecture. Under the NextGen and SESAR programs, a flight management systems (FMS) would need to generate the 4-D trajectory of the aircraft and coordinate with the flight control system to track the 4-D trajectory within required positioning and timing thresholds. Such programs require that the FMS precisely defines an aircraft's intended ground track on the surface of the World Geodetic System 84 (WGS-84) ellipsoidal earth model.

The computation of geodesics and bearings on the surface of an ellipsoidal model involves differential geometry, which is mathematically and computationally complex. While geodetic algorithms exist that can be used to accurately compute the bearing of a geodesic curve and construct the ground track of an aircraft on the surface of the WGS-84 ellipsoidal earth model, such geodetic algorithms require a high computational load. Additionally, constructing the ground track of an aircraft by utilizing such geodesic algorithms would require the design, development, testing, and certification of new software to work with existing aviation equipment.

SUMMARY

In one aspect, embodiments of the inventive concepts disclosed herein are directed to a method. The method may include determining, by a flight management system including a processor, a ground track for a flight leg of an active flight plan based on a spherical earth model, the flight leg including two waypoints including a first waypoint and a second waypoint that are specified with an ellipsoidal earth model. The method may also include determining, by the flight management system, that a parameter associated with the ground track for the flight leg exceeds a predetermined threshold. The method may additionally include, in response to determining that the parameter associated with the ground track for the flight leg exceeds the predetermined threshold, inserting, by the flight management system, at least one anchor point between the two waypoints on a geodesic to effect a course change to the ground track between the two waypoints of the flight leg such that an intended flight path is within specified thresholds. The geodesic is associated with the ellipsoidal earth model. The method may further include modifying, by the flight management system, the ground track for the flight leg to include at least two spherical earth model path segments spanning from the first waypoint through the at least one anchor point to the second waypoint. Each of the at least two spherical earth model path segments are computed based at least on the spherical earth model. The method may additionally include storing data associated with the modified ground track in a non-transitory processor-readable medium.

In a further aspect, embodiments of the inventive concepts disclosed herein are directed to a flight management system including a processor coupled to memory. The processor may be configured to determine a ground track for a flight leg of an active flight plan based at least on a spherical earth model, the flight leg including two waypoints including a first waypoint and a second waypoint that are specified with an ellipsoidal earth model. The processor may also be configured to determine that a parameter associated with the ground track for the flight leg exceeds a predetermined threshold. The processor may additionally be configured to, in response to a determination that the parameter associated with the ground track for the flight leg exceeds the predetermined threshold, insert at least one anchor point between the two waypoints on a geodesic to effect a course change to the ground track between the two waypoints of the flight leg such that an intended flight path is within specified thresholds, the geodesic associated with the ellipsoidal earth model. The processor may further be configured to modify the ground track for the flight leg to include at least two spherical earth model path segments spanning from the first waypoint through the at least one anchor point to the second waypoint. Each of the at least two spherical earth model path segments are computed based at least on the spherical earth model. The processor may also be configured to output data associated with the modified ground track to the non-transitory processor-readable memory.

In a further aspect, embodiments of the inventive concepts disclosed herein are directed to system including a processor communicatively coupled to memory. The processor may be configured to determine a ground track for a flight leg of an active flight plan based at least on a spherical earth model, the flight leg including two waypoints including a first waypoint and a second waypoint that are specified with an ellipsoidal earth model. The processor may also be configured to determine that a parameter associated with the ground track for the flight leg exceeds a predetermined threshold. The processor may additionally be configured to, in response to a determination that the parameter associated with the ground track for the flight leg exceeds the predetermined threshold, insert at least one anchor point between the two waypoints on a geodesic to effect a course change to the ground track between the two waypoints of the flight leg such that an intended flight path is within specified thresholds, the geodesic associated with the ellipsoidal earth model. The processor may further be configured to modify the ground track for the flight leg to include at least two spherical earth model path segments spanning from the first waypoint through the at least one anchor point to the second waypoint. Each of the at least two spherical earth model path segments are computed based at least on the spherical earth model. The processor may also be configured to output data associated with the modified ground track to the non-transitory processor-readable memory.

BRIEF DESCRIPTION OF THE DRAWINGS

Implementations of the inventive concepts disclosed herein may be better understood when consideration is given to the following detailed description thereof. Such description makes reference to the included drawings, which are not necessarily to scale, and in which some features may be exaggerated and some features may be omitted or may be represented schematically in the interest of clarity. Like reference numerals in the drawings may represent and refer to the same or similar element, feature, or function. In the drawings:

FIG. 20 is an illustration of vertical deviation associated with an exemplary embodiment according to the inventive concepts disclosed herein.

DETAILED DESCRIPTION

Figure 1:
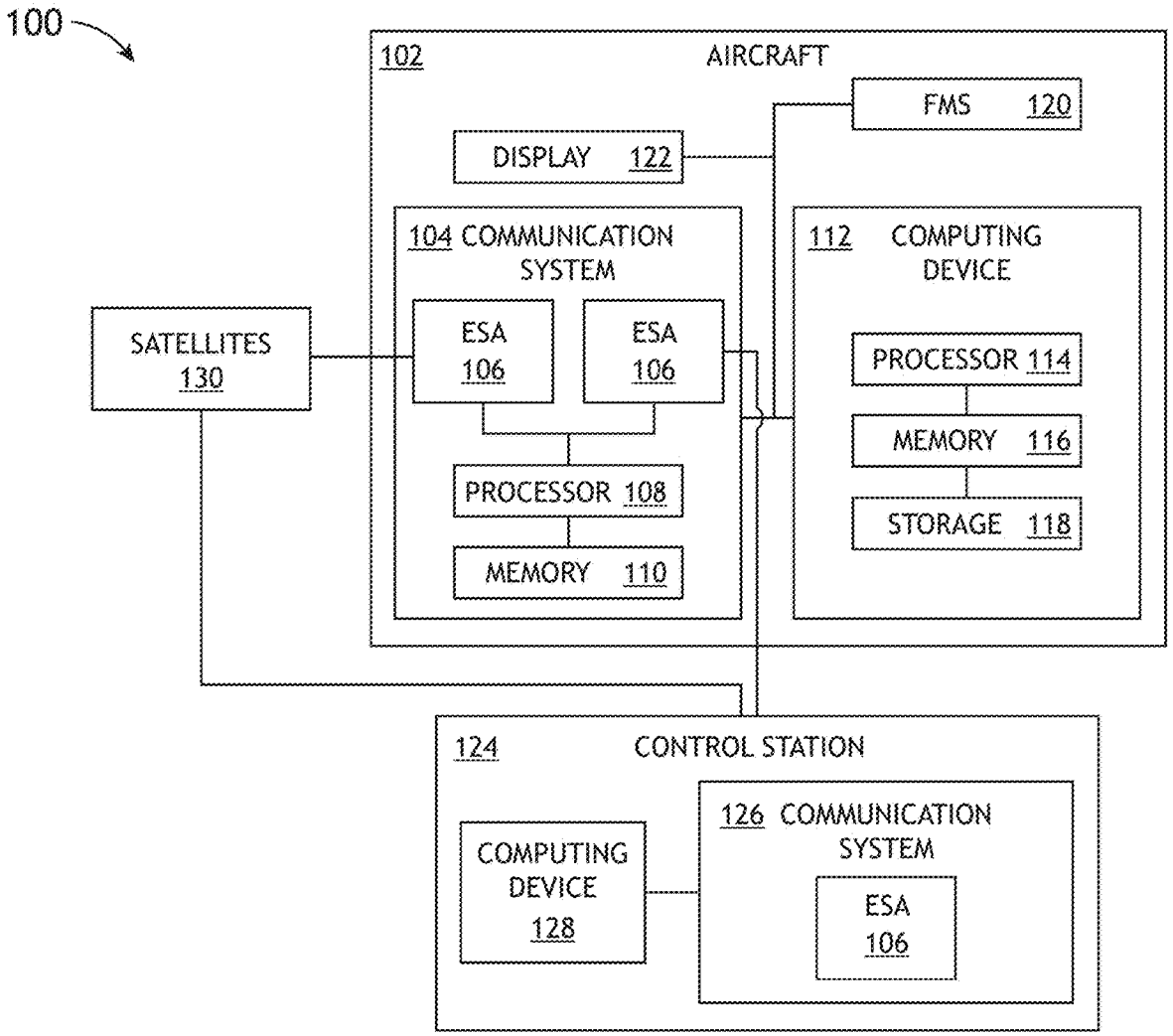
FIG. 1 is a view of an exemplary embodiment of a system according to the inventive concepts disclosed herein.

Before explaining at least one embodiment of the inventive concepts disclosed herein in detail, it is to be understood that the inventive concepts are not limited in their application to the details of construction and the arrangement of the components or steps or methodologies set forth in the following description or illustrated in the drawings. In the following detailed description of embodiments of the instant inventive concepts, numerous specific details are set forth in order to provide a more thorough understanding of the inventive concepts. However, it will be apparent to one of ordinary skill in the art having the benefit of the instant disclosure that the inventive concepts disclosed herein may be practiced without these specific details. In other instances, well-known features may not be described in detail to avoid unnecessarily complicating the instant disclosure. The inventive concepts disclosed herein are capable of other embodiments or of being practiced or carried out in various ways. Also, it is to be understood that the phraseology and terminology employed herein is for the purpose of description and should not be regarded as limiting.

As used herein a letter following a reference numeral is intended to reference an embodiment of the feature or element that may be similar, but not necessarily identical, to a previously described element or feature bearing the same reference numeral (e.g., 1, 1a, 1b). Such shorthand notations are used for purposes of convenience only, and should not be construed to limit the inventive concepts disclosed herein in any way unless expressly stated to the contrary.

Further, unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of embodiments of the instant inventive concepts. This is done merely for convenience and to give a general sense of the inventive concepts, and "a" and "an" are intended to include one or at least one and the singular also includes the plural unless it is obvious that it is meant otherwise.

Finally, as used herein any reference to "one embodiment," or "some embodiments" means that a particular element, feature, structure, or characteristic described in connection with the embodiment is included in at least one embodiment of the inventive concepts disclosed herein. The appearances of the phrase "in some embodiments" in various places in the specification are not necessarily all referring to the same embodiment, and embodiments of the inventive concepts disclosed may include one or more of the features expressly described or inherently present herein, or any combination of sub-combination of two or more such features, along with any other features which may not necessarily be expressly described or inherently present in the instant disclosure.

Broadly, embodiments of the inventive concepts disclosed herein are directed to an FMS configured to utilize a hybrid great circle (HGC) method, which enables the adaptation of existing great circle methodology, to precisely define an intended ground track. Embodiments that utilize the HGC method may be computationally efficient by using the great circle method to compute parameters that are needed at high rates while using complex geodetic algorithms to anchor the flight path within required accuracy thresholds.

Some embodiments include improvements over existing great circle algorithmic methods, which use a spherical earth model, and may reduce development and re-certification cost for FMS products and flight display products. Some embodiments improve existing great circle methods to comply with regulatory requirements to precisely define intended ground track according to ellipsoidal earth models.

Some embodiments are configured to utilize a combination of great circle path calculations and geodetic turn calculations to define an intended ground track that is more accurate than an intended ground track that might be produced using only spherical earth models and less computationally intensive than an intended ground track that might be produced by using only ellipsoidal earth model calculations. Some embodiments may combine the great circle method with the geodetic algorithmic methods. For example, with respect to spherical earth models, a great circle path may be calculated as a three-dimensional curved path on the surface of a spherical earth model with the origin of the curved path located at the center of the spherical earth model. The curved path is rotated with a constant radius relative to the center of a spherical earth model. With respect to ellipsoidal earth models, a geodetic turn may be calculated as a three-dimensional curved path on the surface of an ellipsoidal earth model with the center of the curved path located on the surface of the ellipsoidal earth model. The ground track is expected to turn with a constant radius relative to a location on the surface of the earth model.

Some embodiments save cost and reduce product certification time by including improving existing, certified great circle software rather than developing, testing, and obtaining certification for an entirely new software product. Embodiments that include or utilize the hybrid great circle method are configured to comply with path definition error (PDE) requirements, which may be required to perform precision required navigation performance (RNP) flight procedures, such as RNP 0.1 or less.

Referring now to FIG. 1, an exemplary embodiment of a system 100 according to the inventive concepts disclosed herein includes an aircraft 102, a control station 124, and satellites 130. Some or all of the aircraft 102, the control station 124, and the satellites 130 may be communicatively coupled at any given time.

The aircraft 102 includes a communication system 104, a computing device 112 (which may also be referred to as at least one aircraft computing device), an FMS 120, and a display 112, as well as other systems, equipment, and devices commonly included in aircraft. Some or all of the communication system 104, the computing device 112, the FMS 120, the display 112, and other systems, equipment, and devices commonly included in aircraft may be communicatively coupled.

The communication system 104 includes two electronically scanned arrays (ESAs) 106, a processor 108, and memory 110, which are communicatively coupled. The communication system 104 (such as via one or more of the ESAs 106) is configured to send and/or receive signals, data, messages, and/or voice transmissions to and/or from the control station 124, the satellites 130, and combinations thereof, as well as any other suitable devices, vehicles, equipment, or systems. That is, the communication system 104 is configured to exchange (e.g., bi-directionally exchange) signals, data, messages, and/or voice communications with any other suitable communication system (e.g., communication system 126).

The processor 108 is configured to run various software applications or computer code stored in a non-transitory computer-readable medium (e.g., the memory 110) and configured to execute various instructions or operations. For example, the processor 108 may be configured to receive data from the computing device 112 and execute instructions configured to cause a particular ESA of the ESAs 106 to transmit the data as a signal(s) to another communication system (e.g., 124 or 130) of the system 100. Likewise, for example, the processor 108 may be configured to route data (e.g., flight plan data) received as a signal(s) by a particular ESA of the ESAs 106 to the computing device 112, the FMS 120, and/or the display 122. For example, one or more of the ESAs 106 may be implemented as active ESAs (AESAs).

While the communication system 104 is shown as having two ESAs 106, one processor 108, and memory 110, the communication system 104 may include any suitable number of ESAs 106, processors 108, and memory 110. Further, in some embodiments, the ESAs 106 may be omitted and/or the communication system 104 may include other suitable transmit/receive devices, such as radios, receivers, transmitters, transceivers, antennas, or combinations thereof. Further, the communication system 104 may include other components, such as a storage device (e.g., solid state drive or hard disk drive), radios (e.g., software defined radios (SDRs)), transmitters, receivers, transceivers, antennas, radio tuners, and controllers.

The computing device 112 may include at least one processor 114, a memory 116, and storage 118, as well as other components, equipment, and/or devices commonly included in a computing device, all of which may be communicatively coupled to one another. The computing device 112 may be configured to route data to the FMS 120, the display 122, and/or the communication system 104 for transmission to an off-board destination (e.g., satellites 130 or control station 124). Further, the computing device 112 may be configured to receive data from the FMS 120, the display 122, and/or the communication system 104 received from off-board sources (e.g., satellites 130 or control station 124). The computing device 112 may include or be implemented as and/or be configured to perform the functionality of any suitable aircraft system; for example, in some embodiments, the FMS 120 may be implemented on the computing device 112 as a software application(s) or computer code stored in a non-transitory computer-readable medium (e.g., the memory 116 or the storage 118) and configured to execute various FMS instructions or FMS operations. The processor 114 may be configured to run various software applications or computer code stored in a non-transitory computer-readable medium (e.g., the memory 116 or the storage 118) and configured to execute various instructions or operations. In some embodiments, the aircraft 102 may include any suitable number of computing devices 112.

The display 122 may include projectors (such as an image projector, a retina projector, or the like), liquid crystal cells (e.g., such that the display 122 is implemented as a liquid crystal display (LCD)), light emitting diodes (LEDs) (e.g., such that the display 122 is implemented as an LED display), or a combination thereof. The display 122 may be configured to present various graphical content from any of various avionics systems. Additionally, the display 122 may include or be implemented as a weather display overlay, an engine-indicating and crew-alerting system (EICAS) display overlay, a head-up display (HUD), a head-down display, a head-mounted display (HMD), an integrated display system, a combination thereof, and/or the like. In some embodiments, the display 122 includes or is implemented as a touchscreen display. In some embodiments, the aircraft 102 includes a plurality of displays 122. In some embodiments, the display 122 includes one or more components of a flight control panel. In some embodiments, the display 122 may be omitted. The display 122 may be configured to graphically present any of various content (such as FMS flight plan content) to a user (e.g., a pilot) of the aircraft 102.

The control station 124 includes a communication system 126 and a computing device 128, as well as other systems, equipment, and devices commonly included in a control station. Some or all of the communication system 126, the computing device 128, and other systems, equipment, and devices commonly included in a control system may be communicatively coupled. In one embodiment, the control station 124 may be implemented as a fixed location ground control station (e.g., a ground control station of an air traffic control tower, or a ground control station of a network operations center) or a mobile ground control station (e.g., a ground control station implemented on a non-airborne vehicle (e.g., an automobile or a ship) or a trailer). In some embodiments, the control station 124 is implemented as an air control station implemented on an airborne vehicle (e.g., aircraft).

The communication system 126 and components thereof (such as ESA 106) may be implemented similarly to the communication system 104 except that, in some embodiments, the communication system 126 may be configured for operation at a fixed location. The computing device 128 and components thereof (such as a processor (not shown) and memory (not shown)) of the control station 124 may be implemented similarly to the computing device 112.

Figure 2:
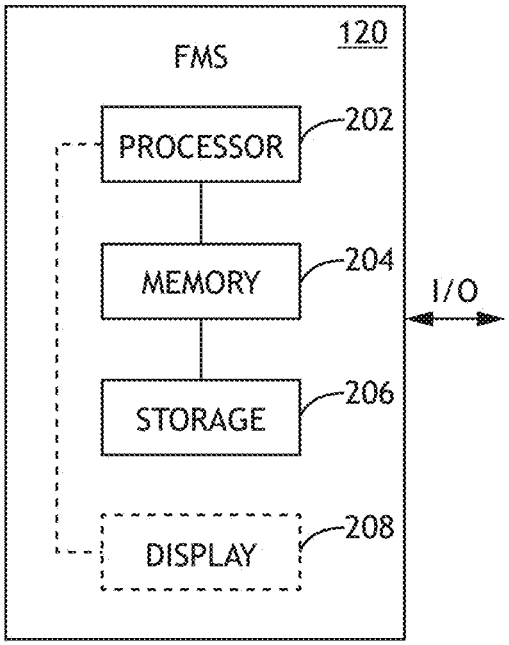
FIG. 2 is a view of an exemplary embodiment of an FMS of the system of FIG. 1 according to the inventive concepts disclosed herein.

Referring now to FIG. 2, an exemplary embodiment of the FMS 120 of the aircraft 102 of FIG. 1 according to the inventive concepts disclosed herein is shown. The FMS 120 includes at least one processor 202, a memory 204, and a storage 206, a display 208, and other components, equipment, and/or devices commonly included in a flight management system. The processor 202, the memory 204, and the storage 206, as well as other components may be communicatively coupled. The processor 202 may be configured to run various software applications or computer code stored in a non-transitory computer-readable medium and configured to execute various instructions or operations, such as flight management system instructions and/or operations.

The FMS 120 is configured to perform any of various flight management operations. The FMS 120 may be configured to determine (e.g., calculate, compute, and/or construct) an intended ground track based on a flight plan. The FMS 120 may be configured to determine an intended ground track by performing a combination of great circle method operations and geodetic algorithmic method operations; for example, the FMS 120 may be configured to perform the hybrid great circle method. For example, the FMS 120 is configured to receive a flight plan request from a pilot and retrieve a requested flight plan from a navigation database (e.g., stored in a non-transitory computer readable medium, such as the memory 204 and/or the storage 206). Additionally, for example, the FMS 120 is configured to perform the hybrid great circle method on the retrieved flight plan. Performing the hybrid great circle method may include modifying the retrieved flight plan. For example, modifying the retrieved flight plan may include parsing the retrieved flight plan; for example, parsing the retrieved flight plan may include adding (e.g., inserting) one or more anchor points to each flight leg and determining (e.g., calculating or computing, such as by the processor 202) associated parameters such that there are smooth and acceptable (e.g., meeting specified RNP standards) PDE transitions between all anchor points and/or waypoints. The FMS 120 may store and/or output the modified flight plan (e.g., the parsed flight plan with one or more anchor points) for use by the FMS 120 or by another device (e.g., an onboard device (e.g., the computing device 112, the display 122, and/or the communication system 104) or an off-board device (e.g., the computing device 128 of the control station 124)). Additionally, the FMS 120 may be configured to perform any of various aircraft performance operations and aircraft navigation and guidance operations.

The display 208 may be communicatively coupled to the processor 202. In some embodiments, the display 208 may be omitted, and for example, the processor 202 may be coupled with the display 122. The FMS 120 allows a pilot to manage, view, monitor, and perform flight tasks (e.g., manual, semi-automated, or automated flight tasks) associated with the aircraft 102. The FMS 120 may allow a pilot to manage, view, monitor, and adjust flight plans associated with the aircraft 102. The FMS 120 may allow a pilot to view graphical output, such as navigational content, flight path and flight plan content, and weather content. The FMS 120 may allow a pilot to interface with controls (such as icon-based controls implemented on a touchscreen display).

The FMS 120 may be configured to send modified FMS data (e.g., modified flight plan data), which may have been determined by the FMS 120 according to the hybrid great circle method, to the control station 124.

Referring generally to FIGS. 3-20, illustrations associated with an exemplary embodiment of a method (e.g., the hybrid great circle method), which may be performed by the FMS 120 of the aircraft 102 of FIGS. 1-2, according to the inventive concepts disclosed herein are shown.

Figure 3:
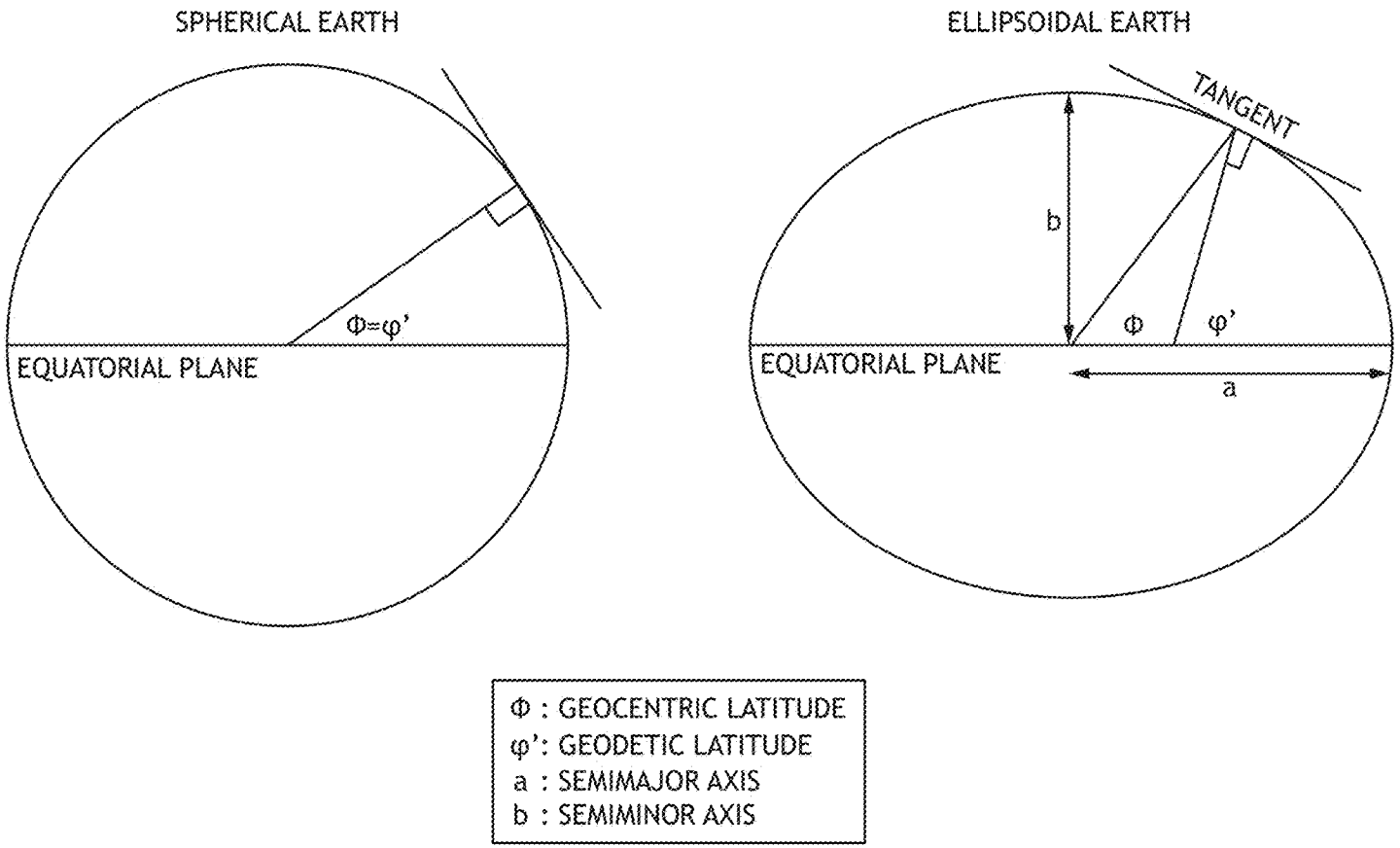
FIG. 3 is an illustration of spherical earth and ellipsoidal earth models associated with an exemplary embodiment according to the inventive concepts disclosed herein.

Referring now to FIG. 3, an illustration of spherical earth and ellipsoidal earth models associated with an exemplary embodiment according to the inventive concepts disclosed herein is shown.

The WGS-84 ellipsoidal earth model is defined as follows:

a=semi-major axis=6,378,137.0 m b=semi-minor axis=6,356,752.314245 m

1/f=inverse flattening=298.257223563

The semi-minor axis is derived from the semi-major axis and the flattening parameter according to the relationship $b=a(1-f)$.

On the other hand, the spherical earth model may use the geometric mean of the WGS-84 semi-major and semi-minor axes as the radius. Thus, the earth radius of this spherical earth model is computed as:

$$\text{Sphere_Radius}=\sqrt{ab}=6{,}367{,}435.679716\text{ m}$$

One difference between a spherical earth model and an ellipsoidal earth model is the definition of latitude. For a spherical earth model, the geocentric latitude is the same as the geodetic latitude, as shown in FIG. 3. However, for an ellipsoidal earth model, the geocentric latitude is different from the geodetic latitude, as shown in FIG. 3.

When computing a ground track with a spherical earth model, the geodetic latitude of a waypoint that is specified with an ellipsoidal earth model is interpreted as the geocentric latitude with a spherical earth model. However, when computing a ground track with an ellipsoidal earth model, the geodetic latitude is used directly in the computation such that the geocentric latitude is not used when computing a ground track with an ellipsoidal earth model.

Figure 4:
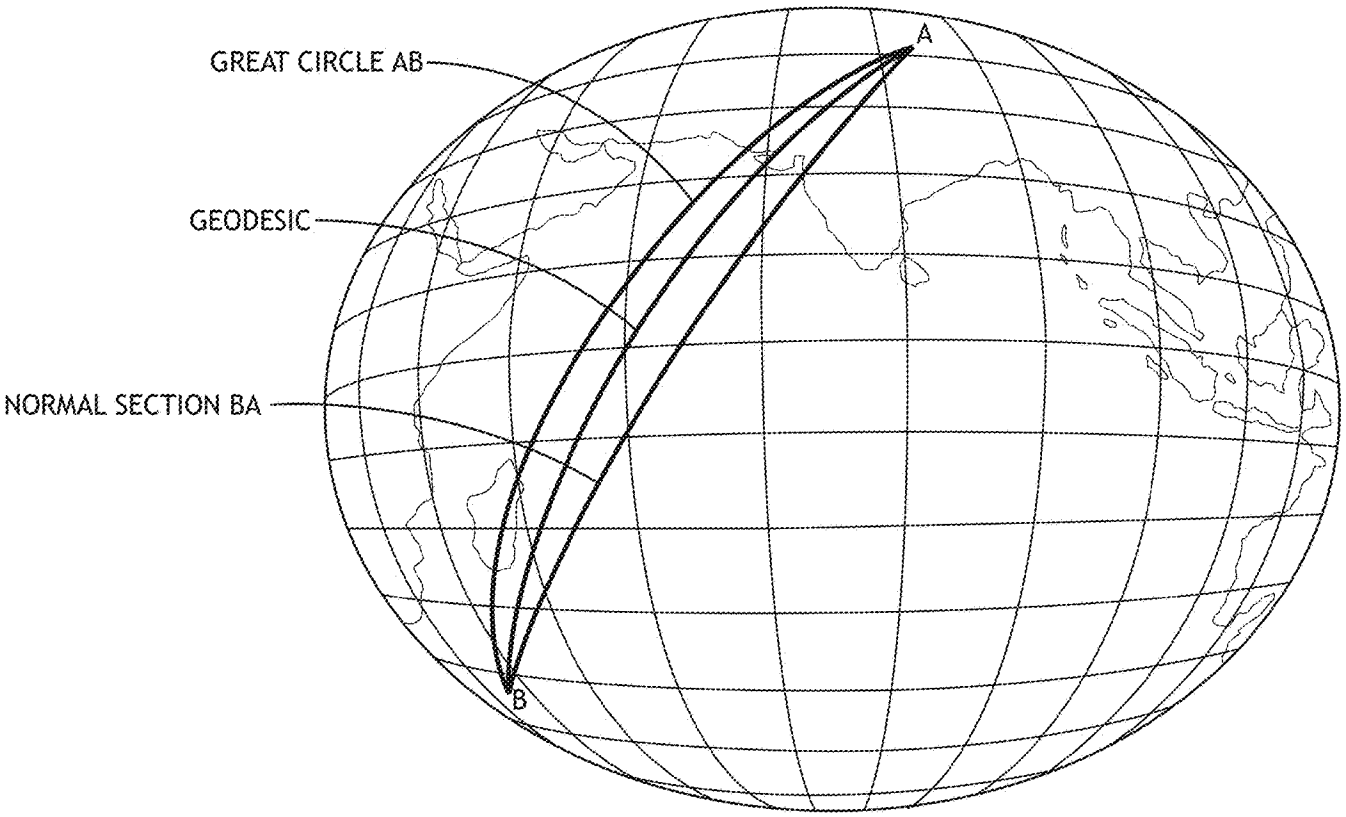
FIG. 4 is a comparative illustration of a geodesic on the surface of an ellipsoidal earth model, a normal section path, and a great circle path associated with an exemplary embodiment according to the inventive concepts disclosed herein.

Referring now to FIG. 4, a comparative illustration of a geodesic on the surface of an ellipsoidal earth model, a normal section path, and a great circle path associated with an exemplary embodiment according to the inventive concepts disclosed herein is shown. Because the WGS-84 ellipsoid is an oblate spheroid, the geodesic curve on such an ellipsoidal earth model is not a plane curve, unlike the great circle path with a spherical earth model. FIG. 4 illustrates notional differences between a geodesic on an ellipsoidal earth model, a normal section path on an ellipsoidal earth model, and a great circle path on a ellipsoidal earth model. The difference between the geodesic on the WGS-84 ellipsoidal earth model and other paths constructed with different methods is defined as the PDE. As shown in FIG. 4, the PDE in the lateral direction is largest at the middle of the leg (between waypoints A and B) because both ends of the leg are anchored by waypoints A, B in an active flight plan specified with WGS-84 coordinates.

Figure 5:
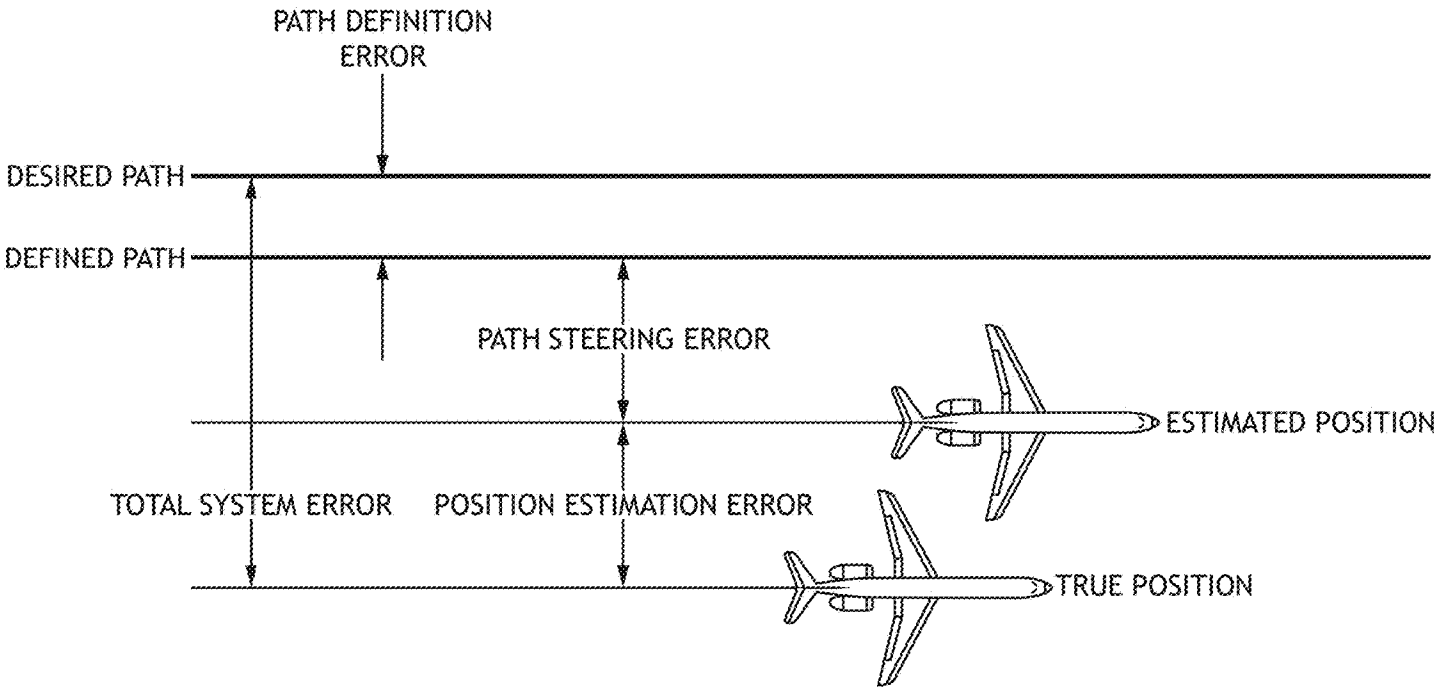
FIG. 5 is an illustration of a path definition error (PDE) in the lateral direction associated with an exemplary embodiment according to the inventive concepts disclosed herein.

Referring now to FIG. 5, an illustration of PDE in the lateral direction associated with an exemplary embodiment according to the inventive concepts disclosed herein is shown. There are a number of error sources and error terms to consider for complying with RNP flight procedures. FIG. 5 illustrates various error terms in the lateral direction for a straight leg. As shown in FIG. 5, the PDE in the lateral direction is defined as $$PDE=\text{desired path}-\text{defined path},$$

where desired path is the geodesic curve on the surface of the WGS-84 ellipsoidal earth model, and where defined path (e.g., a great circle path on the surface of a spherical earth model) may be a path determined by the FMS 120. The path steering error may represent the lateral deviation.

Figure 6:
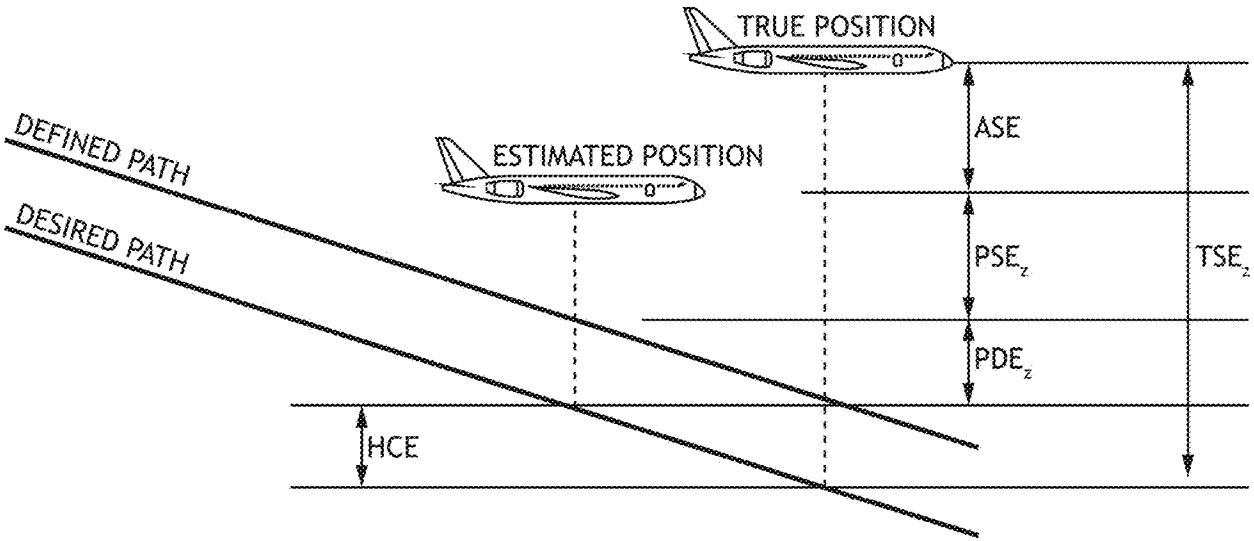
FIG. 6 is an illustration of a PDE in the vertical direction associated with an exemplary embodiment according to the inventive concepts disclosed herein.

Referring now to FIG. 6, an illustration of PDE in the vertical direction associated with an exemplary embodiment according to the inventive concepts disclosed herein is shown. FIG. 6 illustrates error terms considered in the vertical direction. Such error terms do not include the effects of temperature on the altimeter. The PDE for the vertical direction ($PDE_z$) is defined as the vertical difference between the desired path and the defined path at the estimated aircraft location.

With respect to FIGS. 5-6, RNP alerting requirements are based on total system error (TSE). TSE may be defined as the sum of PDE, flight technical error (FTE; e.g., path steering error or lateral/vertical deviation), and position estimation error (sometimes referred to as navigation sensor error (NSE)). The ground track of the desired path may be a geodesic curve on the surface of an ellipsoidal earth model (e.g., the WGS-84 ellipsoidal earth model). PDE may be computed based on the estimated position of the aircraft 102.

Referring generally to FIGS. 7-20, illustrations associated with an exemplary embodiment of a method that includes utilizing geodetic algorithms and great circle algorithms to accurately compute a ground track, deviation(s) (e.g., lateral and vertical deviations), PDE, or the like according to the inventive concepts disclosed herein are shown. Such method may be performed by the FMS 120 of the aircraft 102 of FIGS. 1-2. Geodetic algorithms can be used to accurately compute geodesics, bearings of a geodesic, and lateral deviations on the surface of an ellipsoidal earth model. However, the computational load of performing geodetic algorithms is significantly higher than that of performing great circle-based algorithms. To improve computational efficiency, embodiments include using (e.g., by the FMS 120) great circle-based algorithms to compute deviations (e.g., lateral deviations) and other parameters at suitably fast rates (e.g., 1 Hertz (Hz) or more) when requirements for PDE can be met based on a spherical earth model. For parameters that can be determined (e.g., calculated or computed, such as by the processor 202 or 114) at relatively slower rates (e.g., less than 1 Hz), the FMS 120 may compute such parameters by using geodetic algorithms. Embodiments may include the FMS 120 performing the hybrid great circle method to allow improved computational efficiency while ensuring compliance of requirements for PDE. For example, the HGC method includes computing lateral deviations and other parameters that are needed at relatively fast rates (e.g., at least 1 Hz) by using great circle-based algorithms; however, for parameters that can be computed at relatively slower rates and/or require more accuracy, the HGC method includes computing such parameters by using geodetic algorithms to accurately determine such parameters with respect to the WGS-84 ellipsoidal earth model.

Figure 7:
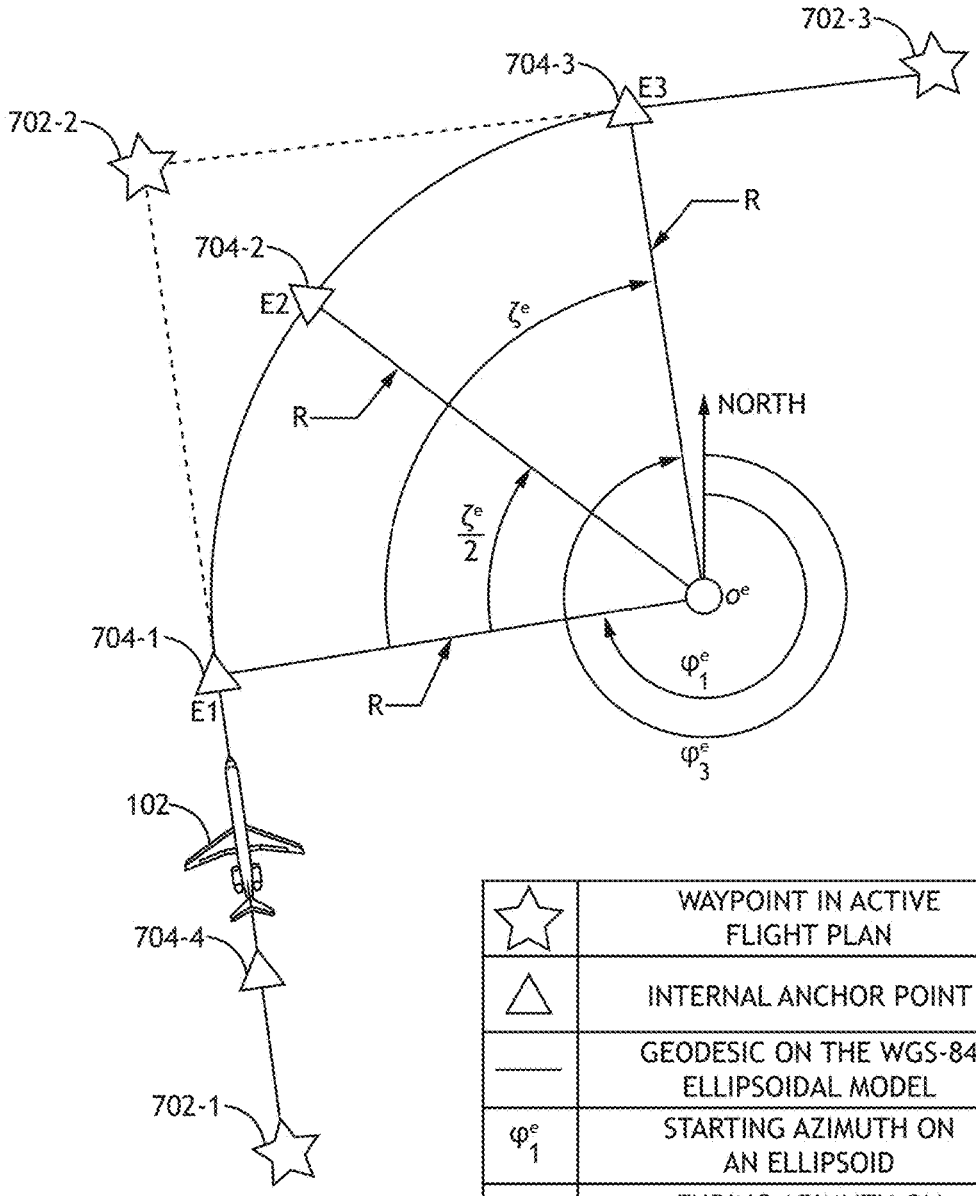
FIG. 7 is an illustration of inserted anchor points on two successive straight flight legs associated with an exemplary embodiment according to the inventive concepts disclosed herein.

Referring now to FIG. 7, an illustration of inserted anchor points on two successive straight flight legs tagged for a fly-by transition associated with an exemplary embodiment according to the inventive concepts disclosed herein is shown.

Latitude and longitude of a waypoint of an active flight plan may be specified with the WGS-84 ellipsoidal coordinate system. Based on the waypoints, current aircraft location, and other data in the active flight plan, the FMS 120 is configured to compute a defined path, lateral deviation (e.g., as may be represented by path steering error in FIG. 5), and a remaining traversal distance between the current aircraft location and a destination, as well as other parameters. PDE tends to increase as segment length between two successive waypoints increases. Embodiments are configured to insert internal anchor points between waypoints to limit the PDE for the defined path to be within an acceptable threshold value.

Embodiments may include performance of a hybrid great circle method. For example, the method may include searching through an active flight plan, determining how many anchor points to insert in an active flight plan to be within a threshold (e.g., a predetermined RNP threshold), determining locations to insert the anchor points, and inserting anchor points on a geodesic between two waypoints (e.g., two sequential waypoints) in the active flight plan. Embodiments include inserting anchor points between waypoints on a geodesic (which may be a ground track) to effect a course change between two or more successive anchor points or waypoints (e.g., between a waypoint and an anchor point or between two anchor points) such that the PDE of the intended flight path is within specified thresholds. Embodiments may include determining a location (e.g., coordinates) for each to-be-inserted anchor point based on the WGS-84 ellipsoidal earth model.

FIG. 7 illustrates the aircraft 102 positioned on a portion of an active flight plan that includes two straight flight legs including a first straight flight leg between waypoint 702-1 and waypoint 702-2 and a second straight flight leg between waypoint 702-2 and waypoint 702-3. The aircraft 102 will undergo a fly-by transition (e.g., which is a common transition between two connected straight flight legs) between the two straight flight legs. An exemplary embodiment includes inserting three internal anchor points 704-1, 704-2, 704-3 (which may be interchangeably be referred to as anchor points E1, E2, and E3, respectively) into the active flight plan to effect the fly-by transition between the two straight flight legs, along with an internal anchor point 704-4 to limit the PDE on the straight leg. An embodiment may include the FMS 120 being configured to perform the hybrid great circle method. For example, the FMS 120 may determine (e.g., compute or calculate) the two anchor points E1 and E3 to be placed at each end of the curved transition path to mark the beginning and ending of the curved transition. Additionally, the FMS 120 may determine a ground track distance on the straight segment between two successive anchor point and/or waypoints (e.g., between waypoints 702-1 and 702-2, between waypoints 702-2 and 702-3, and/or between waypoint 702-1 and anchor point E1) according to the WGS-84 ellipsoidal earth model. If the determined ground track distance is greater than a specified threshold, one or more internal anchor points (e.g., 704-4) may be inserted on the straight path segment to limit the segment length to be within the threshold.

One or more internal anchor points (e.g., E2) may be inserted on the arc segment (e.g., between anchor points E1 and E3) for the fly-by transition to limit the arc segment length and course change according to predetermined thresholds (which, for example, may be based on a predetermined and specified RNP value). The azimuth (or bearing) of a radial within the arc transition may be defined at least in part by the center, $O^e$, of such ellipsoidal arc. For example, $\phi_1{}^e$ of FIG. 7 is the starting azimuth of the arc transition and $\phi_3{}^e$ is the ending azimuth of the arc transition, where the superscript e denotes that the azimuth angle is determined (e.g., measured or calculated) according to an ellipsoidal earth model. $\zeta^e$ of FIG. 7 represents the azimuth extent of the arc transition, where superscript e denotes that $\zeta^e$ is determined (e.g., measured or calculated) according to the ellipsoidal earth model. Ellipsoidal earth model coordinates of anchor point E2 can be determined by using the direct method of the Vincenty's algorithm with the input parameters of the geodetic turn center, $O^e$, an ellipsoidal arc radius, R, and a course bearing of $\phi_1{}^e+\zeta^e/2$.

Once the internal anchor points are determined according to geodetic algorithm, embodiments may include determining and constructing a smooth ground track based at least on the waypoints in the active flight plan and the internal anchor points. In some embodiments, one or more of the waypoints (e.g., waypoints 702-1 and 702-3) may be tagged as internal anchor points such that the FMS 120 uses the internal anchor points to anchor the reference ground track of the aircraft 102 onto the WGS-84 ellipsoidal earth model.

Additionally, a method of inserting anchor points on a curved transition segment between two successive straight legs (e.g., track-to-fix (TF) legs) can similarly be applied to inserting anchor points with respect to radius-to-fix (RF) legs because a curved transition segment that connects two track-to-fix legs is similar to a radius-to-fix leg.

Figure 8:
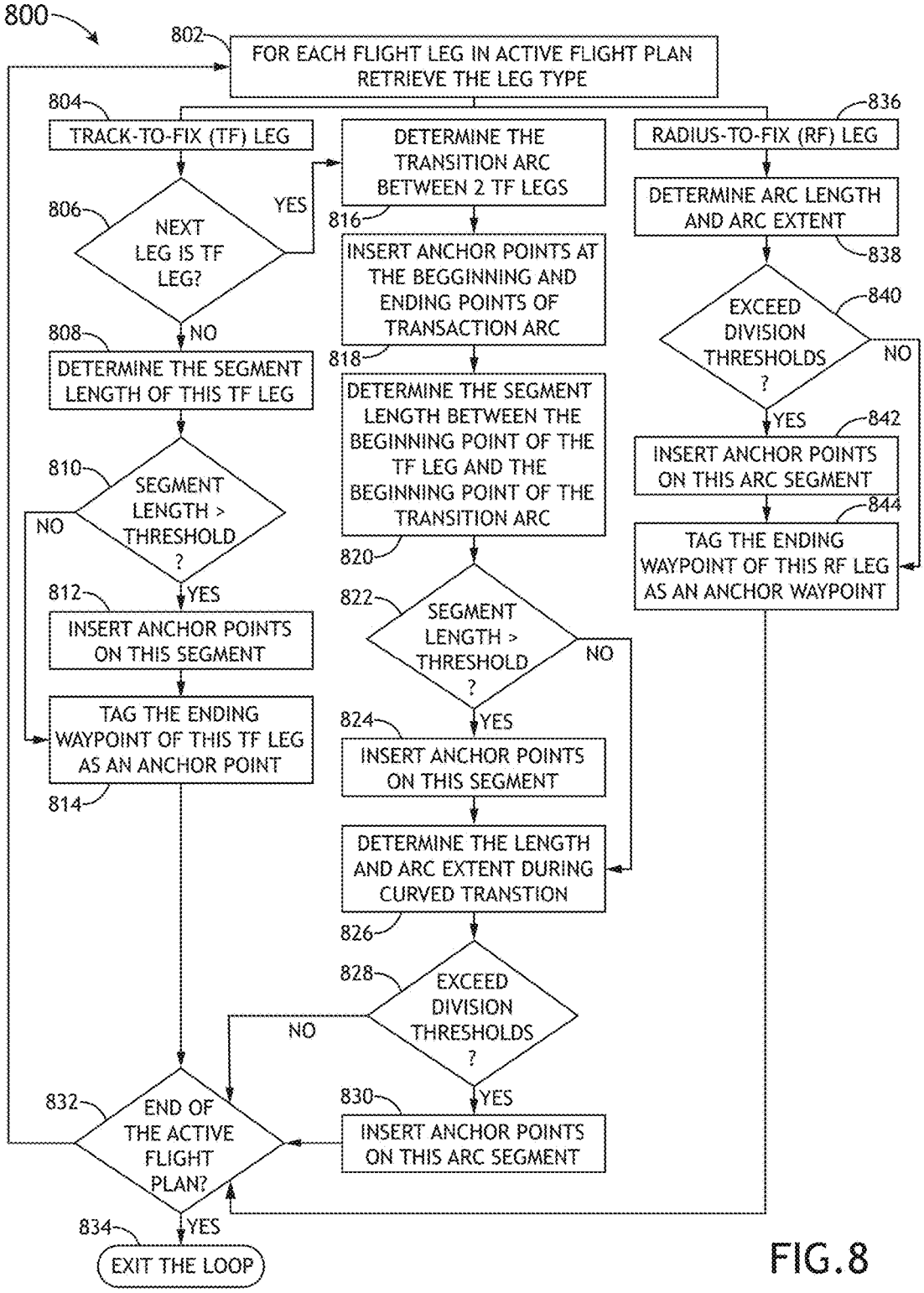
FIG. 8 is a diagram of an exemplary embodiment of a method including processing steps performed by an FMS of FIGS. 1-2 according to the inventive concepts disclosed herein.

Referring now to FIG. 8, an exemplary embodiment of a method 800 of inserting internal anchor points for TF legs and/or RF legs according to the inventive concepts disclosed herein is shown. For example, the hybrid great circle may include or be implemented as the method 800. While the method 800 is described with respect to TF legs and/or RF legs, it is fully contemplated that the method 800 can be applied and/or adapted to other flight leg types that may be allowed for RNP flight procedures. For example, the method 800 for anchor point insertion may be applied to both straight and curved path segments as described throughout. The method 800 may include one or more of the following steps, each of which may be performed by the FMS 120, the processor 202, the computing device 112, the processor 114, the computing device 128, or a combination thereof.

A step 802 may include determining a flight leg type for each flight leg of an active flight plan. For example, for each flight plan, the step 802 may include retrieving a flight leg type, such as from a database stored in storage of the FMS 120.

A step 804 may include determining that the flight leg type is a track-to-fix (TF) leg.

A step 806 may include determining whether the next flight leg (e.g., a leg subsequent to the determined TF leg of step 804) is a TF leg.

Upon a determination that the next flight leg type is not a TF leg, a step 808 may include determining a segment length of the of the TF leg (i.e., the determined TF leg of the step 804).

A step 810 may include determining whether the TF leg's segment length is greater than a predetermined threshold.

If the TF leg's segment length is determined to be greater than the threshold, a step 812 may include inserting one or more anchor points on the TF leg's segment.

If the TF leg's segment length is determined to be less than or equal to the threshold or upon the performance of the step 812, a step 814 may include tagging (e.g., for computational purposes) the ending waypoint (e.g., of the TF leg determined in the step 804) as an anchor point. After performance of the step 814, a step 832 may include determining whether the active flight is completed. If the active flight plan is not completed, the method 800 may include repeating the step 802 with respect to a different (e.g., next or subsequent) flight leg. If the active flight plan is completed, a step 834 may include exiting a processing loop.

Upon a determination that the next flight leg type is a TF leg, a step 816 may include determining (e.g., calculating or computing) a transition arc between the two TF legs.

A step 818 may include inserting anchor points at the beginning and ending points of the transition arc.

A step 820 may include determining a segment length between the beginning point of the TF leg (e.g., determined in the step 804) and the beginning point of the transition arc (e.g., determined in the step 818).

A step 822 may include determining whether the segment length (e.g., determined in the step 820) exceeds a predetermined threshold.

If it is determined that the segment length (e.g., determined in the step 820) exceeds the predetermined threshold, a step 824 may include inserting anchor points in the segment (e.g., between the beginning point of the TF leg (e.g., determined in the step 804) and the beginning point of the transition arc).

If it is determined that the segment length (e.g., determined in the step 820) is less than or equal to the predetermined threshold or if the step 824 was performed, a step 826 may include determining a length and arc extent for the curved transition (e.g., transition arc).

A step 828 may include determining whether either or both of the length and/or arc extent exceeds division thresholds.

If it is determined that either or both of the length and/or arc extent exceeds the division thresholds, a step 830 may include inserting anchor points on the arc segment.

If it is determined that either or both of the length and/or arc extent do not exceed the division thresholds or if the step 830 is performed, the step 832 may be performed as described above.

A step 836 may include determining that the flight leg type is a radius-to-fix (RF) leg.

A step 838 may include determining an arc length and arc extent of the RF leg.

A step 840 may include determining whether either or both of the arc length and/or arc extent exceed division thresholds.

If it is determined that either or both of the arc length and/or arc extent exceed division thresholds, a step 842 may include inserting anchor points on the arc segment of the RF leg.

If it is determined that either or both of the arc length and/or arc extent do not exceed division thresholds or if the step 842 is performed, a step 844 may include tagging the ending waypoint of the RF leg as an anchor waypoint.

Additionally, embodiments may include a step of creating (e.g., constructing, calculating, or computing) a smooth path solution based at least on internal anchor points to predict an intended flight path. In some embodiments, the lateral navigation (LNAV) and vertical navigation (VNAV) functions of the FMS 120 may utilize the smooth path solution and current aircraft location to generate roll and pitch commands, respectively, and other aircraft performance related parameters.

Embodiments may be configured to insert anchor points for straight path segments and curved path segments.

For example, with respect to straight path segments, embodiments may determine quantity and locations to insert anchor points based on various criteria. Because the PDE increases as the path segment length between two successive anchor points increases, the distance between two successive anchor points should be limited to bound the PDE for the defined path. Embodiments, for example that include the hybrid great circle method, may include computing an ellipsoidal ground track distance between two successive anchor points on a straight path segment. If such ellipsoidal ground track distance is greater than a specified threshold, internal anchor points are inserted on the straight path segment to limit the segment length to be within the threshold. Geodetic algorithms may be used to accurately compute the coordinates of internal anchor points in accordance with the WGS-84 ellipsoidal earth model. The specified threshold that is used to limit the length of a straight path segment can vary based on a navigation mode and a maximum allocated PDE. That is, the maximum allowable ground track distance between two successive anchor points can change based at least on navigation mode and the maximum allocated PDE.

For example, with respect to curved path segments, embodiments may determine quantity and locations to insert anchor points based on various criteria. A geodesic or a great circle path may be a 3-dimensional curved path on the surface of a particular earth model with the origin of the curved path located at the center of the particular earth model (e.g., the curved path is rotated relative to the center of the particular earth model). However, and for example, with respect to the curved transition shown in FIG. 7, the origin of the arc transition is not located at the center of the earth model, but at a point on the surface of the particular earth model. In other words, during the arc transition in FIG. 7, the aircraft 102 is expected to turn with a constant radius relative to an origin on the surface of the earth model. Further, the turn radius may be measured as a curved distance along the surface of the given earth model.

Because of the difference between a geodesic (e.g., a turn relative to the center of the particular earth model) and a curved transition path (e.g., a turn relative to a location on the surface of the earth model), it may be inadequate to bound the PDE of a curved transition path by merely limiting the curved transition path's segment length. As such, embodiments may include other or additional factor(s) for determining a quantity and locations for inserting internal anchor points, as well as for limiting the PDE for curved transition paths and RF legs.

Figure 9:
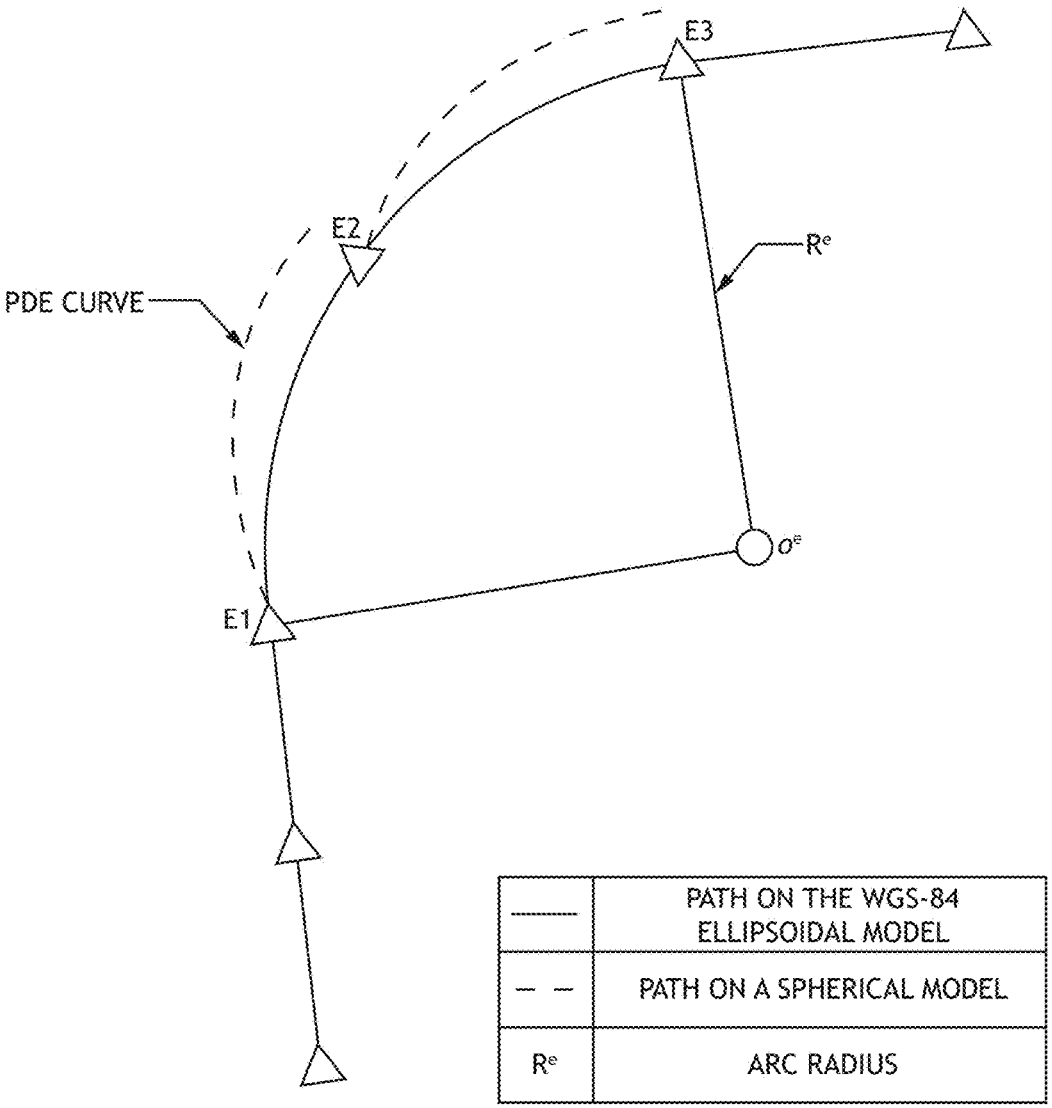
FIG. 9 depicts undesirable PDE jumps that embodiments according to the inventive concepts disclosed herein may avoid.

Referring now to FIG. 9, some embodiments according to the inventive concepts disclosed herein may avoid undesirable PDE jumps, which are depicted in FIG. 9. Embodiments may avoid undesirable PDE jumps when an aircraft sequences through anchor points by accounting for successive anchor points not necessarily being on a same plane as the turn center where three locations, E1, E2, and E3, are on the surface of an ellipsoidal earth model. As such, computing a curved path segment for an ellipsoidal earth model with acceptable PDE by utilizing at least in part a spherical earth model present challenges.

Figure 10:
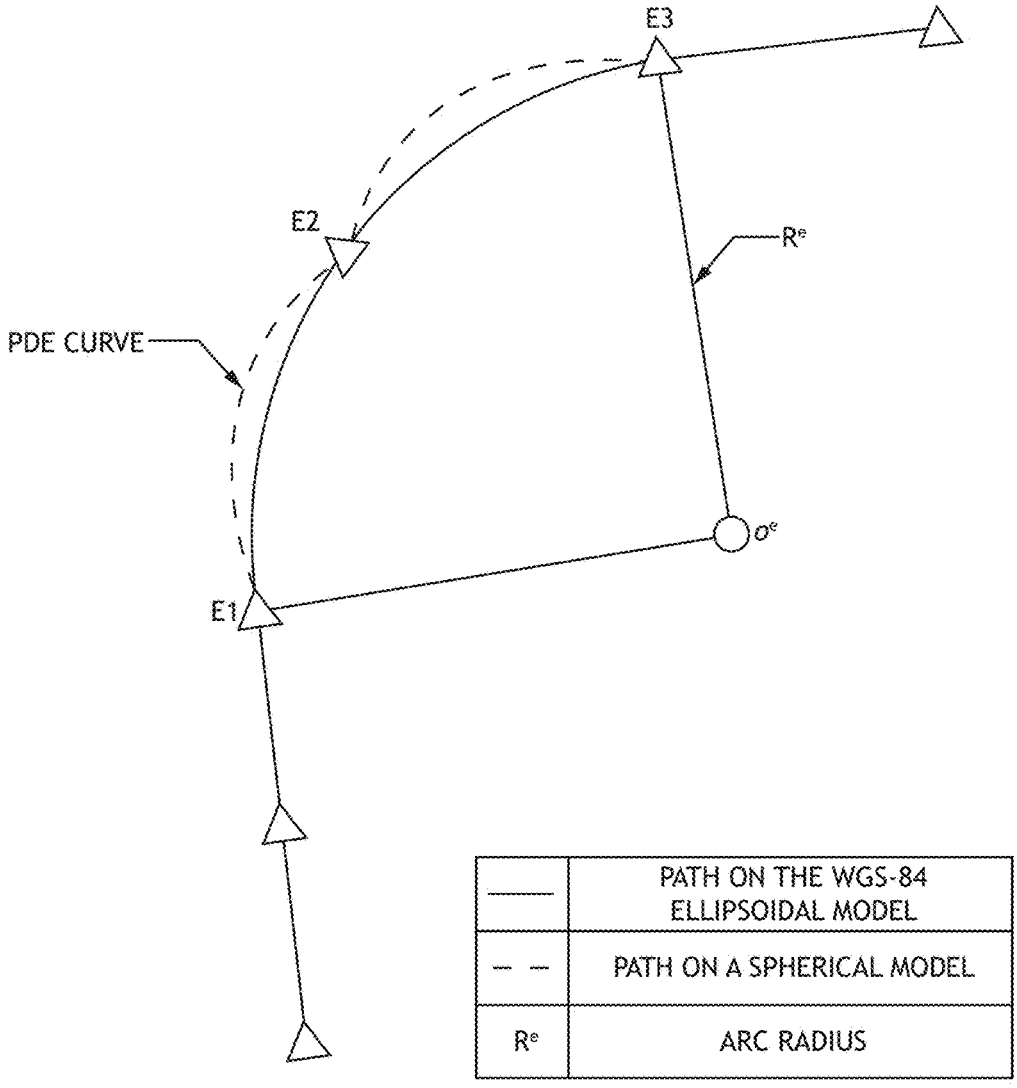
FIG. 10 is an illustration of a smooth PDE curve which is zero at anchor points and peaks near the middle of the arc path segment associated with an exemplary embodiment according to the inventive concepts disclosed herein.

Referring now to FIG. 10, illustrates a smooth PDE curve which is zero at anchor points and peaks near the middle of the arc path segment associated with an exemplary embodiment according to the inventive concepts disclosed herein. FIG. 10 depicts no PDE jumps when aircraft sequences through anchor points. Embodiments are configured to achieve desired PDE curves similar to the PDE curve depicted in FIG. 10.

Figure 11:
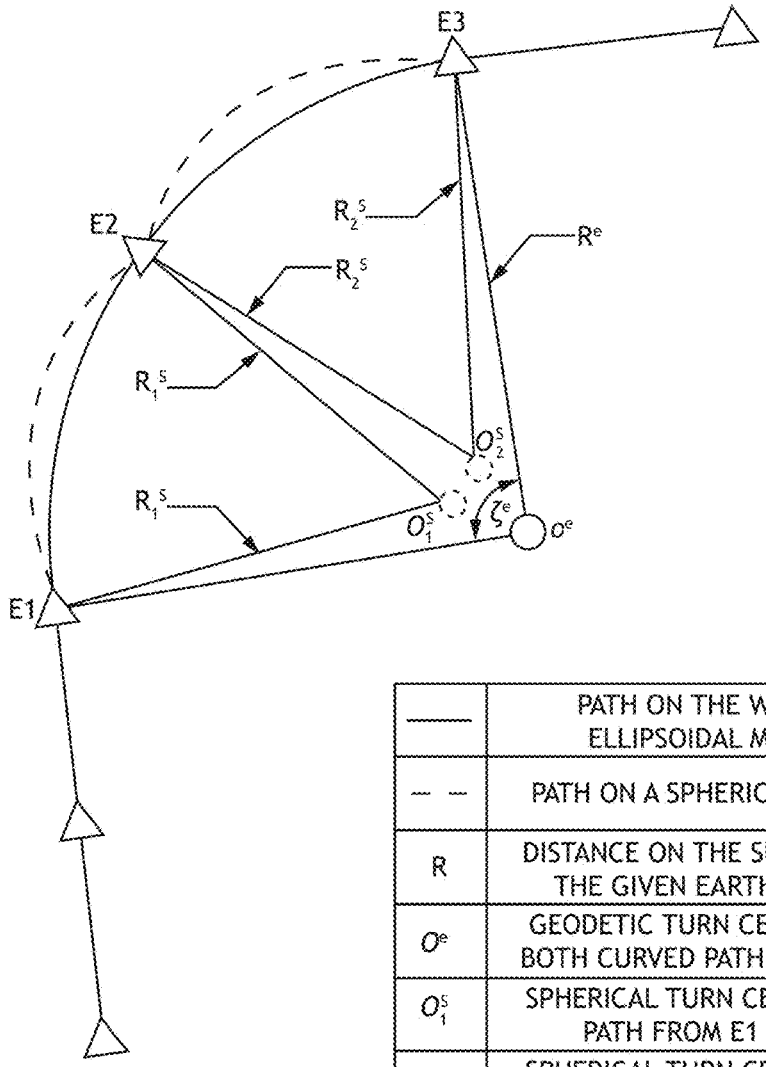
FIG. 11 is an illustration of arc paths between two successive anchor points of an arc transition associated with an exemplary embodiment according to the inventive concepts disclosed herein.

Referring now to FIG. 11, arc paths (e.g., from E1 to E2 and from E2 to E3) between two successive anchor points of an arc transition associated with an exemplary embodiment according to the inventive concepts disclosed herein are shown. The arc paths may be constructed as a curved spherical path segments to approximate a geodetic arc segment based on an ellipsoidal earth model. Each arc path between two successive anchor points on an arc transition may be constructed as a curved spherical path segment with a different turn radius and a different turn center on a spherical earth model so as to approximate the geodetic arc segment based on an ellipsoidal earth model.

In FIG. 11, $O^e$ is the geodetic turn center of the arc transition from E1 to E3 with the superscript e denoting it is associated with an ellipsoidal earth model. $O^e$ is separated from E1, E2 and E3 by a same radial distance of $R^e$. $O_1^s$ is the spherical turn center of the curved spherical path segment from E1 to E2 with the superscript s denoting it is associated with a spherical earth model. $O_1^s$ is separated from both E1 and E2 by the radial distance of $R_1^s$. Similarly, $O_2^s$ is the spherical turn center of the curved spherical segment from E2 to E3. $O_2^s$ is separated from both E2 and E3 by the radial distance of $R_2^s$.

Still referring to FIG. 11, $R_1^s$ and $R_2^s$ may be computed as geometric means of great circle distances, as follows:

$$R_1^s\sqrt{R_{E1O^{e^s}}*R_{E2O^{e^s}}}$$

$$R_2^s\sqrt{R_{E2O^{e^s}}*R_{E3O^{e^s}}}$$

where $R_{E1O^{e^s}}$ is the great circle distance between E1 and $O^e$;

$R_{E2O^{e^s}}$ is the great circle distance between E2 and $O^e$; and $R_{E3O^{e^s}}$ is the great circle distance between E3 and $O^e$.

Embodiments for creating (e.g., inserting) internal anchor points on curved paths may include computing values for the spherical turn radius and spherical turn center of each curved spherical path segment and storing the computed values. The FMS 120, for example, may utilize such values to perform LNAV and VNAV operations associated with computing a smooth path solution until a new active flight plan is received.

To determine the spherical turn center of a curved spherical path segment with a spherical earth model, embodiments may include use of two planes intercepting a sphere, rather than three spheres intercepting each other.

Figure 12:
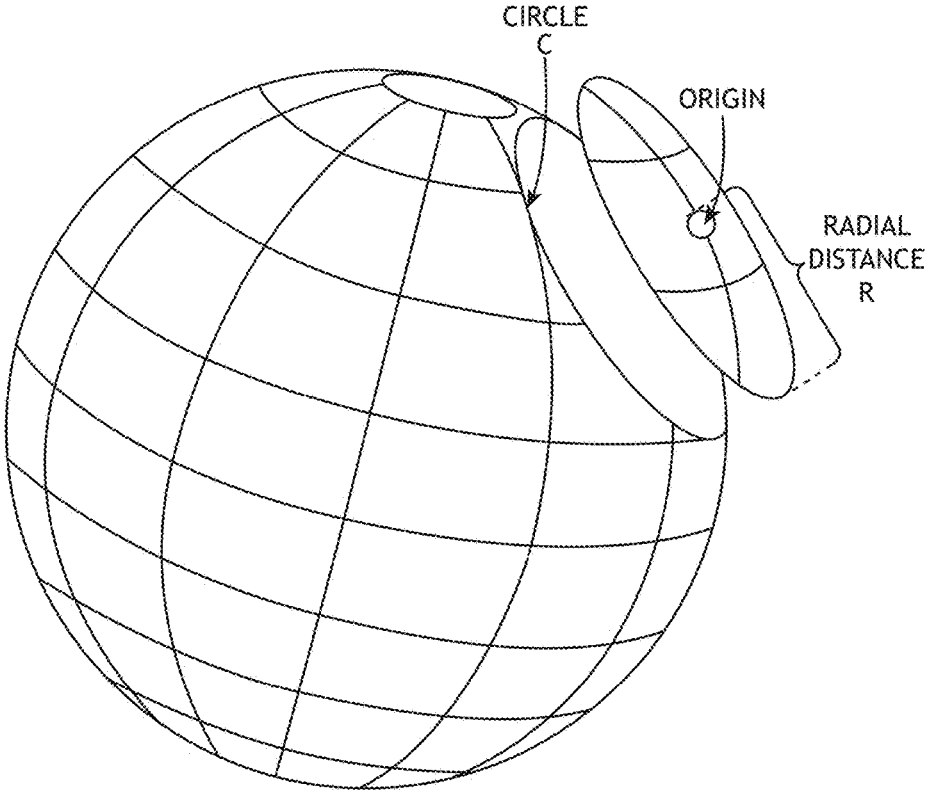
FIG. 12 is an illustration of a plane intercepting a sphere to create a circle on the surface of the sphere in association with an exemplary embodiment according to the inventive concepts disclosed herein.

Referring now to FIG. 12, a plane intercepting a sphere to create a circle on the surface of the sphere in association with an exemplary embodiment according to the inventive concepts disclosed herein is shown. All points on such intercepted circle C are the same radial distance away from a common origin on the surface of the sphere. However, a plane intercepting an ellipsoid does not always create a circle on the surface of the ellipsoid.

Referring now to FIGS. 11 and 12, if E1 (as depicted in FIG. 11) is the origin in FIG. 12, the spherical turn center $O_1^s$ of the curved spherical path between E1 and E2 of FIG. 11 would be located on a first circle $C_{E1}$. Similarly, if the origin in FIG. 12 is E2, the spherical turn center $O_1^s$ of the curved spherical path would be located on a second circle $C_{E2}$. The two circles, $C_{E1}$ and $C_{E2}$, intercept each other at two points, with the point closest to the geodetic turn center $O^e$ being the spherical turn center $O_1^s$ shown in FIG. 11. Embodiments may include locating the spherical turn center of a curved spherical path segment by using such a principle.

Figure 13:
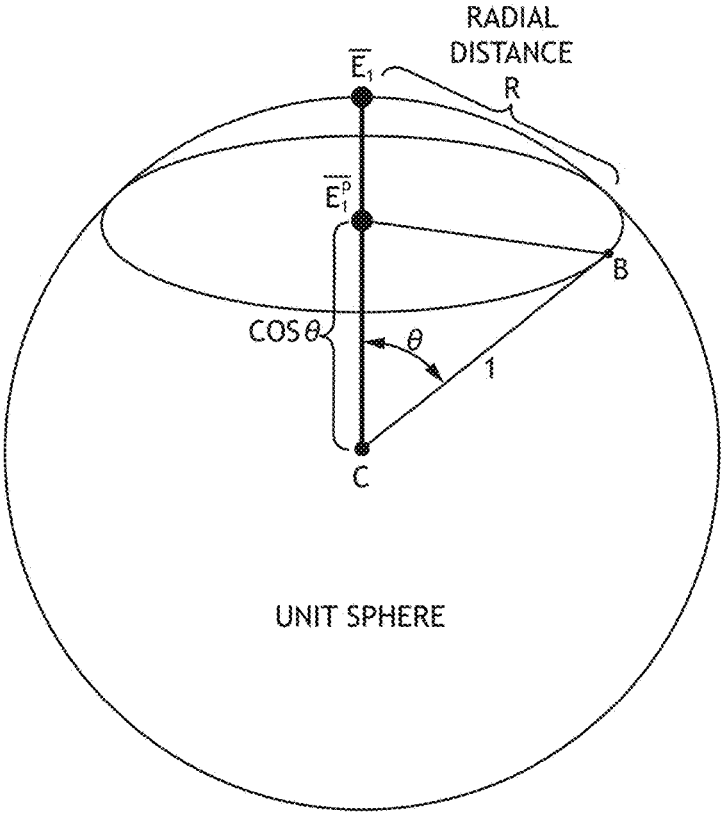
FIG. 13 is an illustration of a plane intercepting a unit sphere to create a circle on the surface of the unit sphere associated with an exemplary embodiment according to the inventive concepts disclosed herein.

Referring now to FIG. 13, a plane intercepting a unit sphere to create a circle on the surface of the unit sphere associated with an exemplary embodiment according to the inventive concepts disclosed herein is shown.

Referring to FIGS. 11-13, embodiments may include a method that utilizes unit sphere geometry and vector algebra principles to determine the spherical turn center of a curved spherical path segment, and such method may include one or more of the following steps:

A first step may include normalizing earth-centered, earth-fixed (ECEF) coordinates of E1, E2, and the geodetic turn center $O^e$ as $\overline{E}_1$, $\overline{E}_2$ and $\overline{O}^e$ to indicate three points on the surface of a unit sphere.

A second step may include determining the two planes that contain the $O_1^s$ on the unit sphere. The second step may include normalizing a radial distance of R to be relative to a unit sphere and computing R's arc angle θ relative to the center line, as shown in FIG. 13.

$$\theta = \frac{R}{\text{Sphere_Radius}}$$

r=θ, due to a unit sphere

The 3D coordinates of $\overline{E}_1^p$ that is on the unit vector from the center of the unit sphere to the point $\overline{E}_1$, as shown in FIG. 13, is $\overline{E}_1^p=\overline{E}_1 \cos\theta$. Thus, the plane containing the circle with the center at $\overline{E}_1^p$, as shown in FIG. 13, can be represented by the point $\overline{E}_1^p$ and its outward pointing unit vector as Plane($\overline{E}_1^p$,$\overline{E}_1$). Similarly, the 3D coordinates of $\overline{E}_2^p$ relative to the point $\overline{E}_2$ can be computed as $\overline{E}_2^p=\overline{E}_2 \cos\theta$. Thus, the plane containing the circle with the center at $\overline{E}_2^p$ can be represented by the point $\overline{E}_2^p$ and its outward pointing unit vector as Plane($\overline{E}_2^p$,$\overline{E}_2$).

A third step may include determining a line that is defined by the intersection of Plane($\overline{E}_1^p$,$\overline{E}_1$) and Plane($\overline{E}_2^p$,$\overline{E}_2$). This interception line may be referred to as $\text{Line}_{Intercept}$. (Note: if $\overline{E}_1$ and $\overline{E}_2$ are a pair of antipodal points, there will be no interception between the two planes because the two planes would be parallel to each other; however, for aviation applications, there are currently no flight legs that would be defined by a pair of antipodal points.)

A fourth step may include determining the two interception points between $\text{Line}_{Intercept}$ and a unit sphere based on the principle that a 3D line intercepts a sphere at two points. The two interception points may be referred to as $\overline{O}_1^E$ and $\overline{O}_2^E$, respectively.

A fifth step may include determining the spherical earth coordinates of the spherical turn center $\overline{O}_1^s$. The fifth step may include converting the Cartesian coordinates of $\overline{O}_1^E$, $\overline{O}_2^E$, and $\overline{O}^e$ to be based on a spherical earth model as follows:

$$O_1^E=\overline{O}_1^E*\text{Sphere_Radius}$$

$$O_2^E=\overline{O}_2^E*\text{Sphere_Radius}$$

$$O^s=\overline{O}^e*\text{Sphere_Radius}$$

The fifth step may include computing the Euclidean distances relative to $O^s$ in the ECEF Cartesian coordinate system as follows:

$$D_1^E=\|O_1^E-O^s\|$$

$$D_2^E=\|O_2^E-O^s\|,$$

where $O^s$ is the geodetic turn center of the arc transition, but according to the spherical earth model.

The fifth step may include determining the ECEF coordinates of the spherical turn center $O_1^s$ as follows:

If $D_1^E<D_2^E$ then $O_1^s=O_1^E$,

Else $O_1^s=O_2^E$

The fifth step may include converting the ECEF coordinates of $O_1^s$ into its latitude and longitude based on a spherical earth model as follows and storing the converted coordinates.

$$\text{Latitude} = \text{atan2}\left(O_{1z}^s, \sqrt{(O_{1x}^s)^2 + (O_{1y}^s)^2}\right)$$

$$\text{Longitude} = \text{atan}(O_{1y}^s, O_{1x}^s),$$

where $(O_{1x}^s, O_{1y}^s, O_{1z}^s)$ are the X, Y, and Z Cartesian coordinates of the location $O_1^s$ on a spherical earth model with the X-axis pointing to 0° N,0° E, the Y-axis pointing to 0° N,90° E, and the Z-axis pointing to 90° N (making a right-handed coordinate system).

Referring to FIGS. 11-14, embodiments may include a method for determining arc extents according to a spherical earth model, and such method may include one or more of the following steps:

A first step for determining (e.g., computing) an arc extent for the curved spherical path segment between E1 and E2 may include determining a normal unit vector to the plane containing anchor point E1, the geodetic turn center $O^e$ of the arc transition, and the center of the spherical earth model by computing the cross product of $O^e$ and E1, as follows:

$$N_{E1}^s = O^e \times E1$$

$$\overline{N}_{E1}^s = \frac{N_{E1}^s}{\|N_{E1}^s\|}$$

(Note that the ECEF coordinates of $O^e$ and E1 may be used for the cross product, even though $O^e$ and E1 are defined as points on the surface of the ellipsoidal earth model; however, the result of the cross product interprets the ECEF coordinates of $O^e$ and E1 according to the spherical earth model.)

A second step for determining the arc extent for the curved spherical path segment between E1 and E2 may include computing the normal unit vector to the plane containing anchor point E2, the geodetic turn center $O^e$ of the arc transition, and the center of the spherical earth model by computing the cross product of $O^e$ and E2, as follows:

$$N_{E2}^s = O^e \times E2$$

$$\overline{N}_{E2}^s = \frac{N_{E2}^s}{\|N_{E2}^s\|}$$

Figure 14:
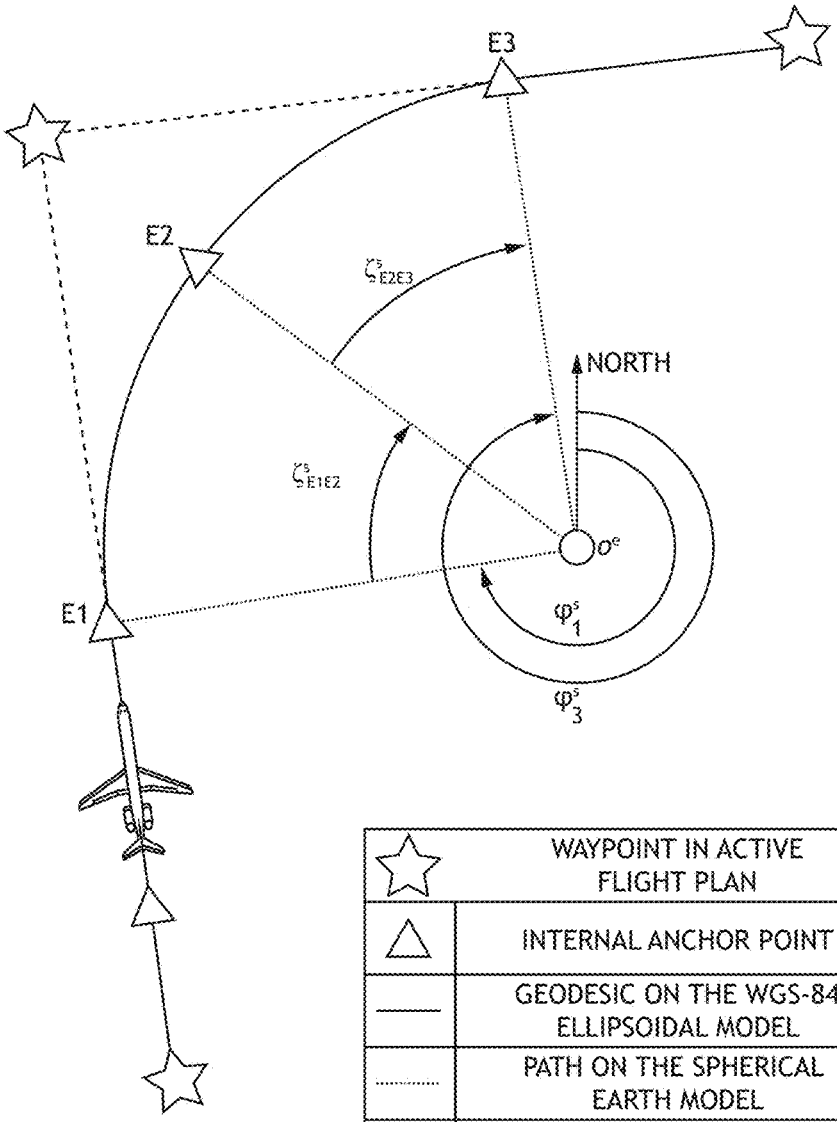
FIG. 14 is an illustration of defined radial bearings according to the spherical earth model for the path example of FIG. 7 according to the inventive concepts disclosed herein.

A third step may include determining (e.g., computing) a bearing extent between the great circle path of $O^e$ to E1 and the great circle path of $O^e$ to E2 by computing the inner product of $\overline{N}_{E1}^s$ and $\overline{N}_{E2}^s$.

$$\zeta_{E1E2}^s = \cos^{-1}(\overline{N}_{E1}^s \cdot \overline{N}_{E2}^s)$$

where $\zeta_{E1E2}^s$ is the bearing extent for the curved spherical path segment between E1 and E2 with the superscript s denoting it is with respect to a spherical earth model, as shown in FIG. 14.

The above steps may be repeated to locate the spherical turn center $O_2^s$ and bearing extent $\zeta_{E2E3}^s$ of the curved spherical path segment from E2 to E3.

Referring again to FIG. 14, defined radial bearings according to the spherical earth model for the path example of FIG. 7 are illustrated according to the inventive concepts disclosed herein. Note that FIG. 14 illustrates radial bearings according to the spherical earth model, while FIG. 7 illustrates radial bearing according to the ellipsoidal earth model, even though FIGS. 7 and 14 use the same path example. As such, because the spherical turn centers and the spherical turn radiuses are constant values until a new active flight plan is received, embodiments that utilize the aforementioned method for determining spherical turn centers and spherical turn radiuses for creating internal anchor points may include storing the values for spherical turn centers and the spherical turn. The FMS 120, for example, may utilize such stored values to perform LNAV and VNAV operations associated with computing a smooth path solution.

Embodiments may include inserting anchor points on curved path segments based on one or more factors. For example, determining whether to insert additional anchor points on a curved path segment or RF leg may be based at least on an evaluation of two parameters, which may include a spherical arc extent between two successive anchor points (e.g., between E1 and E2 or between E2 and E3), as shown in FIG. 14, and the ellipsoidal arc distance between the two successive anchor points. If either of such two parameters exceeds its specified threshold, embodiments include inserting a new anchor point onto the middle of the arc segment bounded by the two successive anchor points. Embodiments may include repeating a step of inserting additional new anchor points until both of spherical arc extent and the ellipsoidal arc extent parameters are within their respective thresholds. Similar to the threshold used to add anchor points on straight path segments, the spherical arc extent threshold and the ellipsoidal arc extent threshold can vary based on any of various factors, such as a particular navigation mode and a maximum allocated PDE. The spherical arc extent threshold and the ellipsoidal arc extent threshold may be based on an assumption that the turn radius is greater than or equal to a predetermined distance (e.g., 1 nmi). As such, if the turn radius is less than the predetermined distance, the spherical arc extent threshold and the ellipsoidal arc extent threshold may need to be evaluated for PDE compliance.

Figure 15:
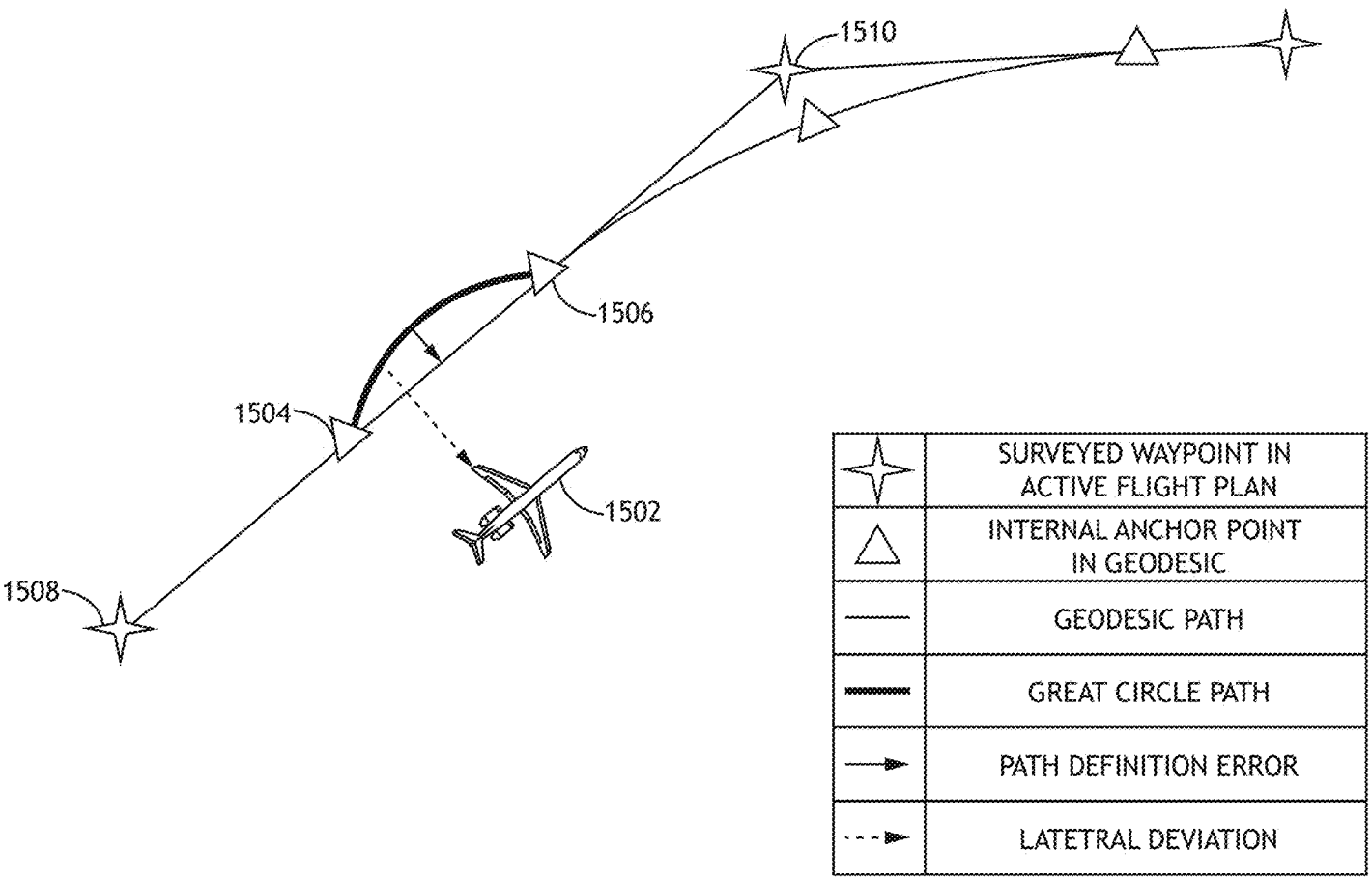
FIG. 15 is an illustration of lateral deviation with respect to a straight flight leg associated with an exemplary embodiment according to the inventive concepts disclosed herein.
Figure 16:
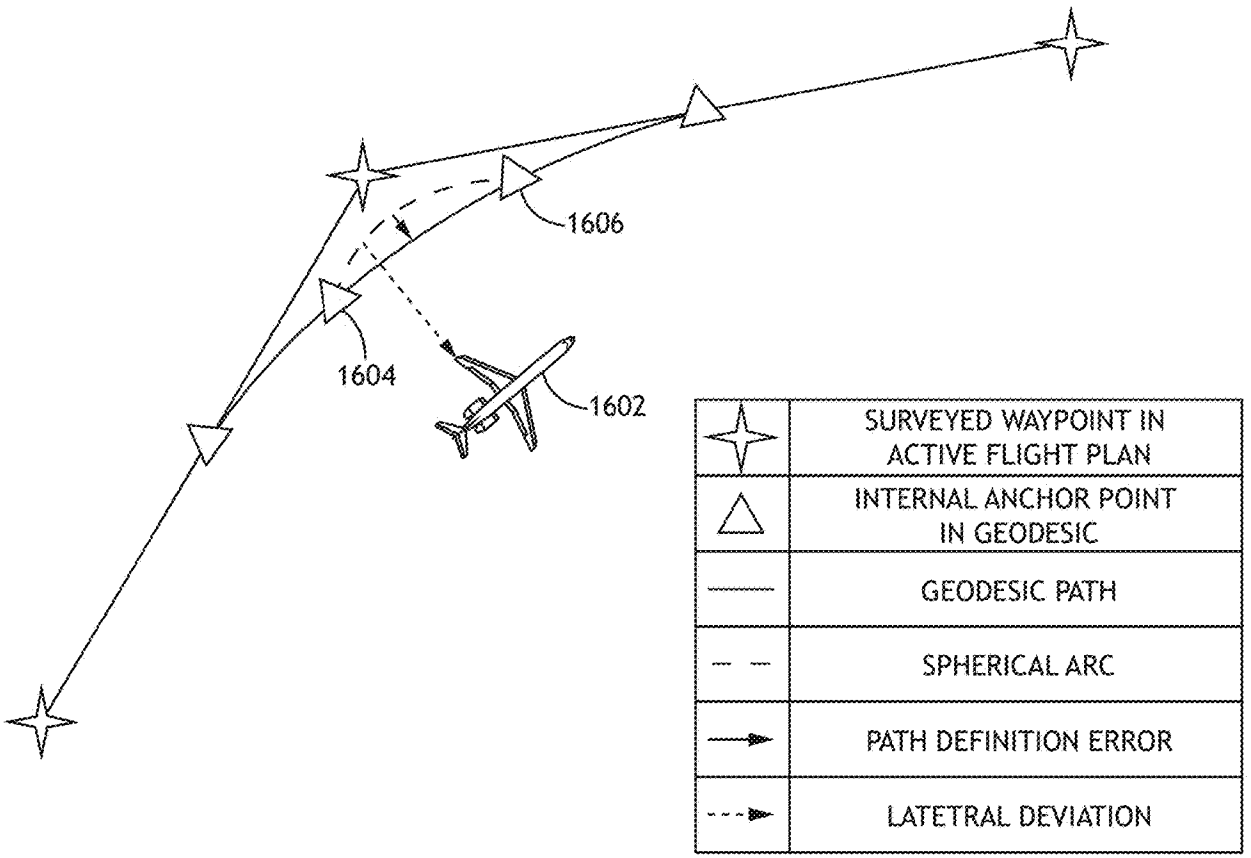
FIG. 16 is an illustration of lateral deviation for a curved transition between two track-to-fix legs associated with an exemplary embodiment according to the inventive concepts disclosed herein.

Referring now to FIGS. 15-16, lateral deviations for straight flight legs and curved flight legs associated with exemplary embodiments according to the inventive concepts disclosed herein are shown. Embodiments may include determining (e.g., computing) lateral deviations based at least on ground location information. For example, computing lateral deviations may be based at least on ground tracks of anchor points and aircraft location.

Referring now to FIG. 15, lateral deviation with respect to a straight flight leg associated with an exemplary embodiment according to the inventive concepts disclosed herein is shown. For example, determining a lateral deviation with respect to a straight flight leg may include a step of determining a great circle path segment that contains an estimated aircraft location and a step of computing a lateral position difference between the estimated aircraft location and the great circle path formed by two successive anchor points. Embodiments may include limiting the segment length between two successive anchor points to be within a predetermined threshold such that the lateral PDE can be bounded within a suitable value. For example, the FMS 120 may be configured for determining a lateral deviation with respect to a straight flight leg.

Figure 17:
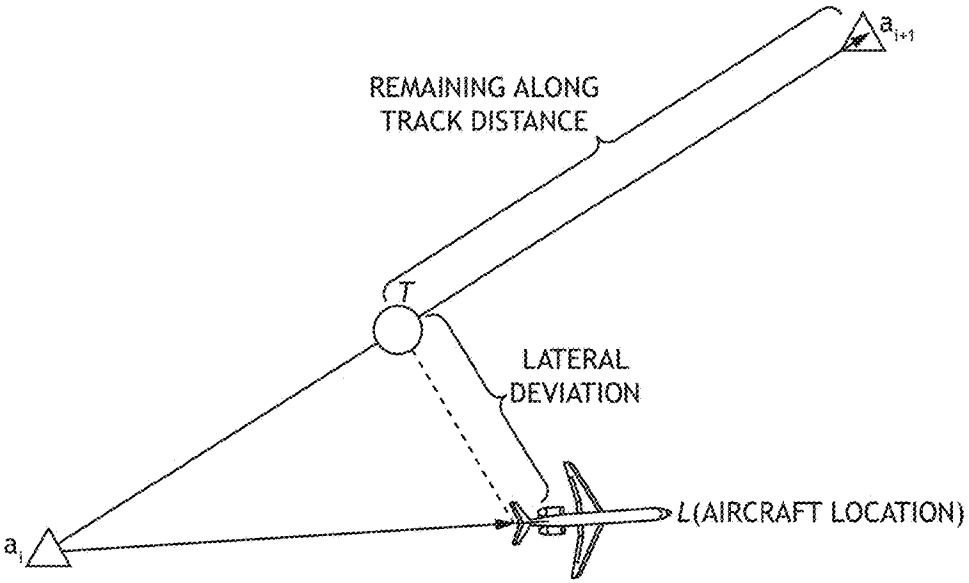
FIG. 17 is an illustration of some geometric relationships associated with an exemplary embodiment according to the inventive concepts disclosed herein.

The FMS 120 may be configured to determine which great circle path segment (e.g., bounded by two successive anchor points, such as 1504 and 1506) contains or is associated with a current aircraft location 1502, as shown in FIG. 15. To determine which great circle path segment contains or is associated with a current aircraft location 1502, the FMS 120 may be configure to perform various operations. For example, if the FMS 120 has access to information that a particular straight path segment (e.g., a straight path segment bounded by two successive points of waypoint 1508, anchor point 1504, anchor point 1506, and waypoint 1510) contains a previous aircraft location, the FMS 120 may loop through each straight path segment for a smooth path solution, as follows:

$$A_i = a_{i+1} - a_i,\ i = j, \ldots, n-2$$

$$B_i = L - a_i,$$

where j is an index for the straight path segment containing the previous aircraft location; $a_i$ is ECEF coordinates of an internal anchor point (e.g., as depicted in FIG. 17); L is the ECEF coordinates of the current aircraft location 1502

(e.g., as depicted in FIG. 17); and n is the total number of anchor points that form straight path segments.

The FMS 120 may be configured to compute the inner product of and $B_i$ and divide it by $\|A_i\|$, as follows:

$$C_i = \frac{A_i \cdot B_i}{\|A_i\|}$$

If $0 \le C_i < \|A_i\|$, then the ith path segment contains the current aircraft location, and the FMS 120 may exit the loop; if the ith path segment does not contain the current path location, the FMS 120 may restart the loop with i iterated as i=i+1. If repeating the loop through all iterations of i does not determine the path segment that contains the current aircraft location 1502, the loop may be repeated with j=0.

Upon determining the path segment that contains the current aircraft location 1502 is determined, the FMS 120 may determine the lateral deviation for the straight flight leg according to the following exemplary steps:

A first step may include normalizing the ECEF coordinates of $a_i$, $a_{i+1}$, and L to be $\bar{a}_i$, $\bar{a}_{i+1}$, and $\bar{L}$ so that their respective coordinates register as points on the surface of a unit sphere. $a_i$ and $a_{i+1}$ (e.g., as depicted in FIG. 17) are the beginning point and the ending point, respectively, of the great circle path segment that contains the current aircraft location. L is the current aircraft location 1502.

A second step may include determining a perpendicular intersection point T (e.g., as depicted in FIG. 17). To determine the perpendicular intersection point T, the FMS 120 may be configured to compute the cross product of $\bar{a}_i$ and $\bar{a}_{i+1}$ as $G=\bar{a}_i \times \bar{a}_{i+1}$, where G is a vector that is normal to the plane containing $\bar{a}_i$, $\bar{a}_{i+1}$, and the center of the unit sphere. To determine the perpendicular intersection point T, the FMS 120 may also be configured to compute the cross product of $\bar{L}$ and G as $F=\bar{L} \times G$, where F is a vector that is normal to the plane containing $\bar{L}$, the G vector, and the center of the unit sphere. To determine the perpendicular intersection point T, the FMS 120 may be further configured to compute the cross produce of G and F as $T=G \times F$ where T is the vector from the center of the unit sphere pointing toward the projection location of the great circle path segment of $\bar{a}_i$ to $\bar{L}$ onto the great circle path segment of $\bar{a}_i$ to $\bar{a}_{i+1}$.

A third step may include normalizing the T vector as $\bar{T}$ so that its coordinates register as a point on the surface of a unit sphere. For example, $\bar{T}$ may be a perpendicular intersection point between the path segment of $\bar{L}$ to $\bar{T}$ and the path segment of $\bar{a}_i$ to $\bar{a}_{i+1}$ on a unit sphere. Further, if necessary, the FMS 120 may be configured to compute the ECEF coordinates of point T with respect to a spherical earth model as $T_{ECEF}=\bar{T}$*Sphere_Radius A fourth step may include computing the lateral deviation by computing $XTD_rad=\cos^{-1}(\bar{T} \cdot \bar{L})$ where XTD_rad is in units of radians and is the lateral deviation between aircraft and the great circle path segment of $a_i$ to $a_{i+1}$, such that the lateral deviation may be computed in meters as Lateral_Deviation=Sphere_Radius*XTD_rad. FIG. 17 illustrates the geometric relationships among $a_i$, $a_{i+1}$, L, T, lateral deviation, and the remaining along track distance associated with an exemplary embodiment according to the inventive concepts disclosed herein.

A fifth step may include determining a sign (e.g., negative or positive) of the lateral deviation. Conventionally, the sign of lateral deviation is defined as positive to the right side of the vector from $a_i$ to $a_{i+1}$ (e.g., from a top-down view), and the FMS 120 may be configured to compute the sign of the lateral deviation as follows:

The FMS 120 may be configured to compute a cross product of $\bar{a}_i$ and $\bar{a}_{i+1}$ as $N=\bar{a}_i \times \bar{a}_{i+1}$. The FMS 120 may also be configured to compute a vector from $\bar{T}$ to $\bar{L}$ as $X=\bar{L}-\bar{T}$. The FMS 120 may further be configured to compute an inner product of X and N as $Z=X \cdot N$. If $Z \le 0$, the FMS 120 may determine that the lateral deviation is positive; otherwise, the lateral deviation may be considered as negative.

Referring again to FIG. 17, the remaining along track distance on the path segment of model $\bar{a}_i$ to $\bar{a}_{i+1}$ may be computed by the FMS 120 according to the inventive concepts disclosed herein. For example, the FMS 120 may be configured to perform a method for computing the remaining along track distance, where the method may include one or more steps as follows:

A first step may include computing the great circle distance of the path segment. For example, the FMS 120 may be configured to compute a great circle distance between two locations—$P_1(lat_1,lon_1)$ and $P_2(lat_2,lon_2)$—by computing $$d_rad=|\cos^{-1}[\sin(lat_1)\sin(lat_2)+\cos(lat_1)\cos(lat_2)\cos(lon_1-lon_2)]|$$

$$d=d_rad*Sphere_Radius,$$

where d_rad may be a great circle distance in radians, d may be a great circle distance in meters, and latitudes and longitudes may be in radians. Additionally, the FMS 120 may be configured to compute Dist_aL, which is the great circle distance between $a_i$ and L, by substituting $P_1$ with the latitude and longitude of $a_i$ and substituting $P_2$ with the latitude and longitude of L in the aforementioned equation for computing d_rad.

A second step may include computing the remaining along track distance on the path segment. For example, the FMS 120 may configured to compute the great circle distance between $a_i$ and T as $$Dist_aT=\{\cos^{-1}[\cos(dist_aL_rad)/\cos(XTD_rad)]\}*Sphere_Radius,$$

where dist_aL_rad may be the great circle distance between $a_i$ and L in radians (which may be determined according to the equation set forth with respect to the first step), and where XTD_rad may be the lateral deviation in radians computed as $TD_rad=\cos^{-1}(\bar{T} \cdot \bar{L})$. The FMS 120 may be configured to compute the remaining along track distance as Remaining_Along_Track_Dist=Path_Dist−Dist_aT, where Path_Dist is the great circle distance of the path segment from $a_i$ to $a_{i+1}$, Dist_aT is the great circle distance of the path segment from $a_i$ to T, and Remaining_Along_Track_Dist is the remaining great circle distance from T to $a_{i+1}$, as shown in FIG. 17, and the variable's units may be in meters.

Referring again to FIG. 16, lateral deviation for a curved transition between two TF legs associated with an exemplary embodiment according to the inventive concepts disclosed herein is shown. For example, the lateral deviation may be computed as a difference between (a) the radius of the arc transition and (b) a great circle distance between an estimated aircraft location and the origin of the spherical arc on the surface of the spherical earth model. The FMS 120 may be configured to compute a lateral deviation for a curved transition between two TF legs.

The FMS 120 may be configured to determine which arc segment (e.g., bounded by two successive anchor points, such as 1604 and 1606, contains a current aircraft location 1602, as shown in FIG. 16. Based on previously determined and stored turn centers and radiuses of curved spherical path segments, the FMS 120 may be configured to determine which curved spherical path segment contains the current aircraft location 1602, such as by performing vector algebra operations.

If the FMS 120 has access to information of a previous aircraft location in a particular curved path segment, the FMS 120 may be configured to loop through the curved path segments in the smooth path solution with the starting index i=j, where j is the index for the curved path segment containing the previous aircraft location. The FMS 120 may be configured to compute the great circle path distance $GC_i^L$ between aircraft location L (e.g., shown in FIGS. 17-20) and the geodetic turn center $O_i^e$ of the ith arc path segment.

If $GC_i^L<2R_i$, the FMS 120 may be configured to check the course bearing of the great circle path from $O_i^e$ to L to determine whether the aircraft location L is within an azimuth extent of the ith arc segment. Otherwise (i.e., if $GC_i^L$ is greater than or equal to $2R_1$), the FMS 120 may skip the ith arc segment and loop to the next curved transition (i.e., i=i+1).

The FMS 120 may be configured to compute a normal unit vector to a plane containing the aircraft location L, the geodetic turn center $O_i^e$ of the ith arc transition, and the center of the spherical earth model by computing $N_{i,ac}^s=O_i^e\times L$ and $$\overline{N}_{i,ac}^s = \frac{N_{i,ac}^s}{\|N_{i,ac}^s\|},$$

where j is the index for the curved path segment containing the previous aircraft location. (Note that the ECEF coordinates of $O_i^e$ and L may be used even though $O_i^e$ and L may be defined as points on the surface of the ellipsoidal earth model; the ECEF coordinates of $O_i^e$ and L may be interpreted by the equation of $N_{i,ac}^s=O_i^e\times L$ according to the spherical earth model.

Figure 18:
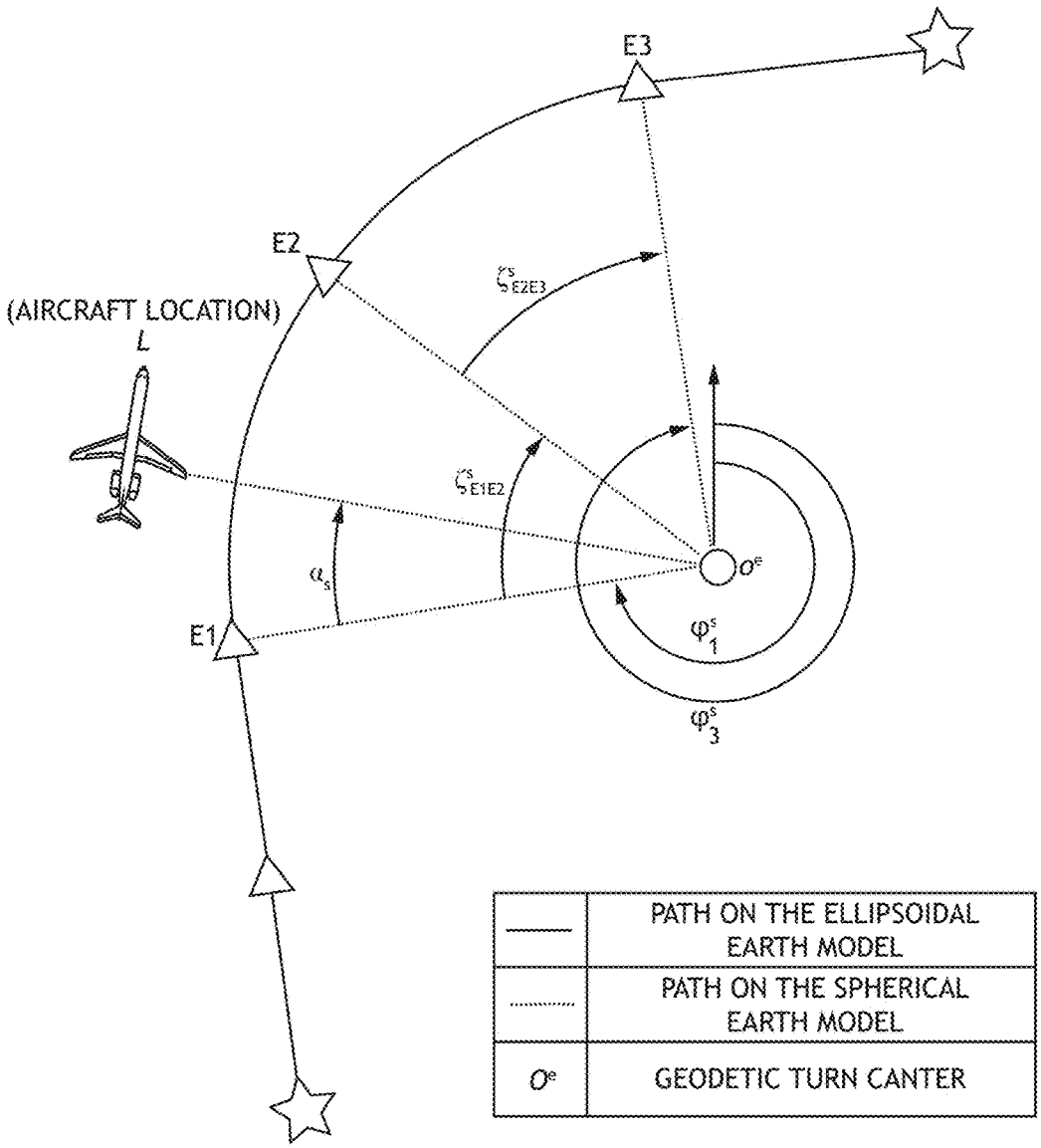
FIG. 18 is an illustration of some radial bearing relationships according to the spherical earth model by using the flight path example in FIG. 7 in accordance with the inventive concepts disclosed herein.

The FMS 120 may be configured to compute the normal unit vector to a plane containing $a_i$ (which may be defined as the beginning anchor point for the curved spherical path segment from $a_i$ to $a_{i+1}$), the geodetic turn center $O_i^e$ of the ith arc transition, and the center of the spherical earth model. The point $a_i$ (e.g., which is shown in FIG. 18) may be the anchor point E1 for the curved spherical path segment from E1 to E2. Additionally, the point, $O_i^e$, is a geodetic turn center (e.g., $O^e$) and not a spherical turn center, such as $O_1^s$. The FMS 120 may be configured to compute the normal unit vector according to $N_i^s=O_i^e\times a_i$ and $$\overline{N}_i^s = \frac{N_i^s}{\|N_i^s\|}.$$

Additionally, the FMS 120 may be configured to compute a bearing extent between the great circle path of $O_i^e$ to $a_i$ and the great circle path of $O_i^e$ to L as $\alpha^s=\cos^{-1}(\overline{N}_i^s\cdot\overline{N}_{i,ac}^s)$. The FMS 120 may be configured to retrieve the bearing extent $\zeta_i^s$ for the curved spherical path segment from $a_i$ to $a_{i+1}$ on the spherical earth model and compare it with $\alpha^s$ (e.g., as shown in FIG. 18). If $\alpha^s<\zeta_i^s$, the FMS 120 may determine that the ith curved spherical path segment contains the current aircraft location 1602 and may exit the loop; otherwise, the FMS 120 may loop to the next curved transition (i.e., i=i+1). The FMS 120 may perform computations involving course bearings by utilizing sign and rollover conventions. FIG. 18, illustrates a relationship among $\alpha^s$, $\zeta_i^s$, and $O_i^e$ according to the spherical earth model by using the flight path example in FIG. 7 and in accordance with the inventive concepts disclosed herein.

On the other hand, if the curved path segment that contains the previous aircraft location is unknown to the FMS 120, the FMS 120 may loop through the curved path segments in the smooth path solution with a starting index of i=0. As such, the FMS 120 may compute a great circle path distance $GC_i^L$ between aircraft location L and the geodetic turn center $O_i^e$ of the ith arc transition.

If $GC_i^L<2R_i$, the FMS 120 may store the ith curved spherical path segment a potential candidate data structure (e.g., a potential candidate list G) for verification based on a course bearing.

The FMS 120 may be configured to sort the candidate list G in an ascending order so that a center of the curved spherical path segment which is closest to the current aircraft location becomes a first element of the candidate list.

The FMS 120 may start with the first element of the candidate list G to verify whether the current aircraft location is within the azimuth extent of this curved spherical path segment by using the above-described design steps for computing the normal unit vectors and the bearing extent. Based on a verification that the current aircraft location 1602 is within the azimuth extent of this curved spherical path segment, the FMS 120 may determine the curved spherical path segment that contains the current aircraft location 1602.

Upon determining that a particular curved spherical path segment contains the current aircraft location 1602, the FMS 120 may compute the lateral deviation as a difference between (a) the radius of the arc and (b) the great circle distance from the spherical turn center $O_i^s$ to L. Additionally, for example, the lateral deviation may be computed using the notations illustrated in FIG. 19 as Lateral_Deviation=$R_1^s-GC_{O_1^s}^L$, where $R_1^s$ is the turn radius (e.g. previously computed as $R_1^s=\sqrt{R_{E1O^e}^{s}*R_{E2O^e}^{s}}$), and $GC_{O_1^s}^L$ is the great circle distance from the spherical turn center $O_1^s$ to the current aircraft location L.

Referring now to FIGS. 16-19, the FMS 120 may be configured to determine an approximate (e.g., estimated) remaining along track distance on the curved spherical path segment of E1 to E2 based on $$\theta = \frac{R_1^s}{\text{Sphere_Radius}},\ R' = R_1^s\sin\theta,$$

and $S_{remaining}=(\zeta_{E1E2}^s-\alpha^s)R'$, where $R_1^s$ is the turn radius, and $\zeta_{E1E2}^s$ and $\alpha^s$ are the azimuth extents according to the spherical earth model as shown in FIG. 18; and $S_{remaining}$ is the remaining along track distance on the curved spherical path segment from E1 to E2.

Figure 19:
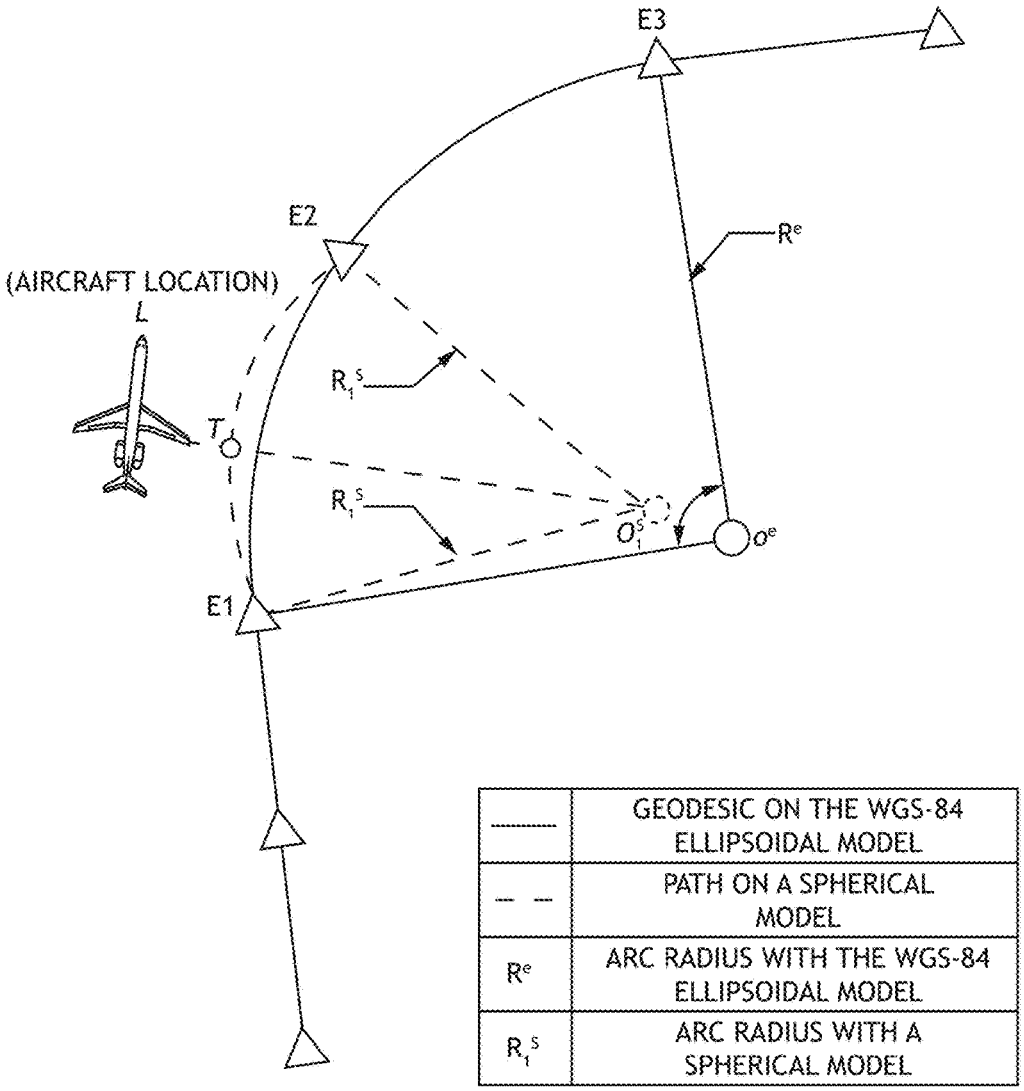
FIG. 19 is an illustration of lateral deviation associated with an exemplary embodiment according to the inventive concepts disclosed herein.

In some embodiments, with respect to operations related to lateral turns, the FMS 120 may be configured to compute and/or measure radial bearings at the geodetic turn center (e.g., as illustrated in FIG. 18), and the FMS 120 may be configured to compute lateral deviations based on the spherical turn center (e.g., as shown in FIG. 19).

Referring now to FIG. 20, a vertical descent profile associated with an exemplary embodiment according to the inventive concepts disclosed herein is shown. A vertical deviation may be defined as a difference between an actual altitude and a defined altitude at an estimated aircraft location. For example, the vertical deviation can be represented as Vertical_Deviation=$h_{actual}-h_{defined}$, where h actual is an actual pressure or barometric altitude of the aircraft; $h_{defined}$ is a defined altitude on the flight path profile based on an estimated position.

The vertical PDE may be defined as a difference between a desired altitude and a defined altitude at an estimated aircraft location and can be represented as Vertical PDE=$h_{desired}-h_{defined}$, where $h_{desired}$ is a pressure or barometric altitude on a desired flight path profile based on the estimated aircraft location.

For the notional descent vertical profile shown in FIG. 20, the pressure or barometric altitude at point T is the defined altitude, $h_{defined}$. The desired altitude $h_{desired}$ may be computed by using the geodesic length between the estimated aircraft position and the beginning anchor point, for example, as $h_{desired}=h_{E1}-S_{ac}^{e}\tan\gamma^{e}$, where $h_{E1}$ is an altitude at anchor point E1 shown in FIG. 20; Δh may be an altitude change between two successive anchor points; $D^e$ may be a path length on the WGS-84 ellipsoidal model; $S_{ac}^{e}$ may be a geodesic between the aircraft and the beginning waypoint on the WGS-84 ellipsoidal model; and $\gamma^e$ may be defined such that $\tan(\gamma^e)=\Delta h/D^e$.

In some embodiments, the FMS 120 is configured to approximate $S_{ac}^{e}$ as the great circle path length of $S_{ac}^{s}$ to compute $h_{defined}$ at Point T as $h_{defined}=h_{E1}-S_{ac}^{s}\tan\gamma^{e}$, where $S_{ac}^{s}$ is a great circle path length between the aircraft and the beginning anchor point with the superscript s denoting it is according to the spherical earth model.

As such, the path length error for using $S_{ac}^{s}$ to approximate $S_{ac}^{e}$ results in a vertical $PDE_z$ that the FMS 120 may compute as $PDE_z=h_{desired}-h_{defined}$.

In some embodiments, a maximum value of $PDE_z$ occurs at or near the middle of a descent path segment, and $PDE_z$ is zero or approximately zero at the anchor points E1 and E2 that form the descent path segment. To achieve substantially zero $PDE_z$ at the anchor points E1 and E2 and a maximum $PDE_z$ at the middle of the descent path segment, the FMS 120 may be configured to compute $h_{defined}$ based at least in part on whether the great circle distance between anchor point E1 and the aircraft is smaller than the great circle distance between anchor point E2 and the aircraft. If the great circle distance between anchor point E1 and the aircraft is smaller than the great circle distance between anchor point E2 and the aircraft, the FMS 120 may be configured to compute $h_{defined}$ as $h_{defined}=h_{E1}-S_{E1toAC}^{s}\tan\gamma^{e}$; otherwise, the FMS 120 may be configured to compute $h_{defined}$ as $h_{defined}=h_{E2}+S_{ACtoE2}^{s}\tan\gamma^{e}$. $S_{E1toAC}^{s}$ may be defined as the great circle distance between the anchor point E1 and the aircraft. $S_{ACtoE2}^{s}$ may be defined as the great circle distance between aircraft and the anchor point E2. $h_{E1}$ may be defined as the altitude of the anchor point E1. $h_{E2}$ may be defined as the altitude of the anchor point E2.

The FMS 120 may be configured to compute the $PDE_z$ at the middle point of the descent path segment as $$\begin{aligned} PDE_z^{middle} &= \frac{\Delta h}{2} - \frac{D^s}{2}\tan\gamma^e \\ &= \frac{\Delta h}{2}\left(1 - \frac{D^s}{D^e}\right) \\ &= \frac{\Delta h}{2}\left(1 - \frac{D^e + \Delta D}{D^e}\right) \\ &= \frac{-\Delta h \Delta D}{2D^e} \end{aligned}$$

-continued $$= \frac{-\Delta D}{2}\tan\gamma^e,$$

where $PDE_z^{middle}$ is the vertical PDE at the middle point of the descent path segment; $D^s$ is the great circle path length between anchor points E1 and E2 shown in FIG. 20; and ΔD is the path length difference between $D^e$ and $D^s$. To bound the maximum vertical PDE (i.e., $PDE_z^{middle}$) within a specified threshold, the FMS 120 may be configured to determine a maximum allowable altitude change between two successive anchor points as $$|\Delta h_{max}| < \frac{2D^e TD_{PDE}^z}{\Delta D}, \text{ for } |\Delta h| > 0,$$

where $TD_{PDE}^z$ is a threshold for the maximum vertical PDE and $\Delta h_{max}$ is the maximum allowable altitude difference between two successive anchor points (e.g., E1 and E2).

Figure 21:
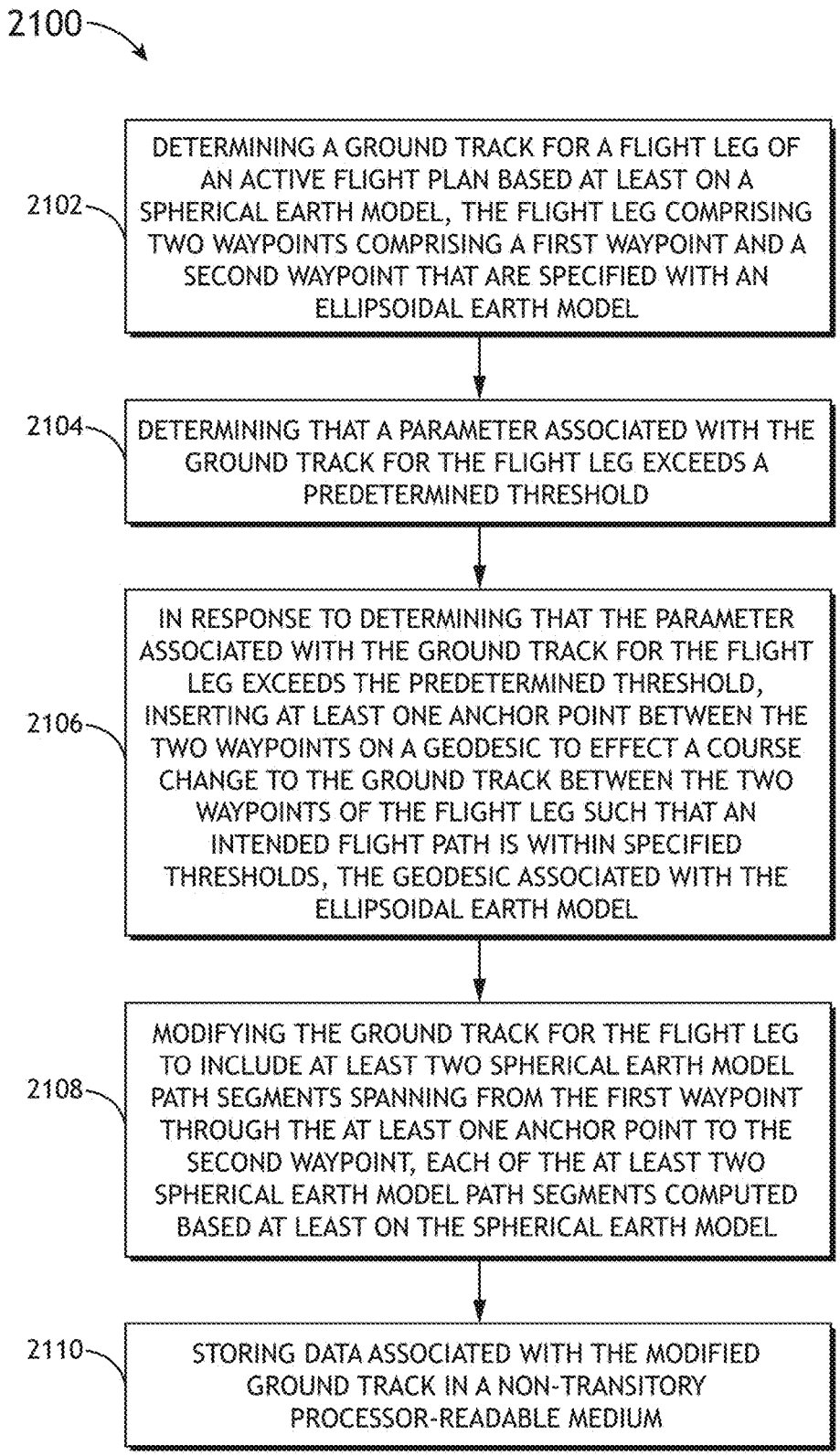
FIG. 21 is a diagram of an exemplary embodiment of a method of operating the FMS of FIGS. 1-2 according to the inventive concepts disclosed herein.

Referring now to FIG. 21, an exemplary embodiment of a method 2100 according to the inventive concepts disclosed herein may include one or more of the following steps. The method 2100 may include one or more of the following steps, each of which may be performed by the FMS 120, the processor 202, the computing device 112, the processor 114, the computing device 128, or a combination thereof.

A step 2102 may include determining a ground track for a flight leg of an active flight plan based at least on a spherical earth model, the flight leg comprising two waypoints comprising a first waypoint and a second waypoint that are specified with an ellipsoidal earth model.

A step 2104 may include determining that a parameter associated with the ground track for the flight leg exceeds a predetermined threshold.

A step 2106 may include in response to determining that the parameter associated with the ground track for the flight leg exceeds the predetermined threshold, inserting at least one anchor point between the two waypoints on a geodesic to effect a course change to the ground track between the two waypoints of the flight leg such that an intended flight path is within specified thresholds, the geodesic associated with the ellipsoidal earth model.

A step 2108 may include modifying the ground track for the flight leg to include at least two spherical earth model path segments spanning from the first waypoint through the at least one anchor point to the second waypoint, each of the at least two spherical earth model path segments computed based at least on the spherical earth model.

A step 2110 may include storing data associated with the modified ground track in a non-transitory processor-readable medium, such as the memory 204.

Further, the method 2100 may include any of the operations disclosed throughout.

Embodiments may be configured to retrofit existing FMSs that use great circle software while complying with any PDE requirements specified by aviation regulations. For example, embodiments may be configured to achieve a lateral PDE of less than 3 meters for TF legs, a lateral PDE of less than 10 meters for RF legs, and a vertical PDE of less than 3 meters. Embodiments may include a cost-effective and computationally efficient method and FMS that uses a combination of the great circle method to compute parameters that are needed at high rates while using geodetic methods to anchor the waypoints of the flight path. The performance of embodiments has been evaluated according to a world-wide PDE analysis. According to the results from the world-wide PDE analysis, embodiments can limit the PDE to within specified thresholds and enable aircraft to perform precision RNP flight procedures.

As used throughout, "at least one" means one or a plurality of; for example, "at least one" may comprise one, two, three, . . . , one hundred, or more. Similarly, as used throughout, "one or more" means one or a plurality of; for example, "one or more" may comprise one, two, three, . . . , one hundred, or more.

In the present disclosure, the methods, operations, and/or functionality disclosed may be implemented as sets of instructions or software readable by a device. Further, it is understood that the specific order or hierarchy of steps in the methods, operations, and/or functionality disclosed are examples of exemplary approaches. Based upon design preferences, it is understood that the specific order or hierarchy of steps in the methods, operations, and/or functionality can be rearranged while remaining within the scope of the inventive concepts disclosed herein. The accompanying claims may present elements of the various steps in a sample order, and are not necessarily meant to be limited to the specific order or hierarchy presented.

It is to be understood that embodiments of the methods according to the inventive concepts disclosed herein may include one or more of the steps described herein. Further, such steps may be carried out in any desired order and two or more of the steps may be carried out simultaneously with one another. Two or more of the steps disclosed herein may be combined in a single step, and in some embodiments, one or more of the steps may be carried out as two or more sub-steps. Further, other steps or sub-steps may be carried in addition to, or as substitutes to one or more of the steps disclosed herein.

From the above description, it is clear that the inventive concepts disclosed herein are well adapted to carry out the objects and to attain the advantages mentioned herein as well as those inherent in the inventive concepts disclosed herein. While presently preferred embodiments of the inventive concepts disclosed herein have been described for purposes of this disclosure, it will be understood that numerous changes may be made which will readily suggest themselves to those skilled in the art and which are accomplished within the broad scope and coverage of the inventive concepts disclosed and claimed herein.

What is claimed is:

1. A method, comprising:

determining, by a flight management system comprising a processor, a ground track for a flight leg of an active flight plan based at least on a spherical earth model, the flight leg comprising two waypoints comprising a first waypoint and a second waypoint that are specified with an ellipsoidal earth model;

determining, by the flight management system, that a parameter associated with the ground track for the flight leg exceeds a predetermined threshold;

in response to determining that the parameter associated with the ground track for the flight leg exceeds the predetermined threshold, inserting, by the flight management system, at least one anchor point on a geodesic and between the two waypoints, the geodesic associated with the ellipsoidal earth model;

modifying, by the flight management system, the ground track for the flight leg to include at least two spherical earth model path segments spanning from the first waypoint through the at least one anchor point to the second waypoint, each of the at least two spherical earth model path segments computed based at least on the spherical earth model, wherein modifying the ground track for the flight leg effects a course change to the ground track between the two waypoints of the flight leg such that an intended flight path is within specified thresholds; and storing data associated with the modified ground track in a non-transitory processor-readable medium.

2. The method of claim 1, wherein the non-transitory processor-readable medium is a non-transitory processor-readable memory, wherein storing the data associated with the modified ground track in the non-transitory processor-readable medium comprises storing the data associated with the modified ground track in the non-transitory processor-readable memory.

3. The method of claim 1, wherein modifying the ground track for the flight leg to include the at least two spherical earth model path segments improves a computational efficiency of the flight management system by requiring fewer computational operations to compute the ground track than a computation of an ellipsoidal earth model ground track for the flight leg.

4. The method of claim 1, wherein modifying the ground track for the flight leg effects the course change to the ground track between the two waypoints of the flight leg such that an intended flight path is within specified thresholds and such that a path definition error is approximately zero at each of the at least one anchor points.

5. The method of claim 4, wherein the at least one anchor point is at least two anchor points comprising a first anchor point and second anchor point, wherein inserting, by the flight management system, the at least one anchor point on the geodesic and between the two waypoints comprises:

inserting, by the flight management system, the at least two anchor points on the geodesic and between the two waypoints, wherein modifying the ground track for the flight leg effects a course change to the ground track between the two waypoints of the flight leg such that an intended flight path is within specified thresholds and such that a path definition error for a segment between the first anchor point and the second anchor point is greatest at approximately halfway between the first anchor point and the second anchor point.

6. The method of claim 1, further comprising determining, by the flight management system, that the flight leg is a track-to-fix flight leg.

7. The method of claim 6, wherein the parameter is a segment length between the two waypoints, wherein determining, by the flight management system, that the parameter associated with the ground track for the flight leg exceeds the predetermined threshold comprises:

determining, by the flight management system, that the segment length between the two waypoints associated with the ground track for the track-to-fix flight leg exceeds the predetermined threshold.

8. The method of claim 6, wherein the track-to-fix flight leg is a first track-to-fix flight leg, the method further comprising:

determining, by the flight management system, that a next flight leg is a second track-to-fix flight leg immediately following the first track-to-fix flight leg;

determining, by the flight management system, a transition arc between the first track-to-fix flight leg and the second track-to-fix flight leg; and inserting, by the flight management system, an anchor point at a beginning of the transition arc.

9. The method of claim 1, wherein the flight leg is a radius-to-fix flight leg, wherein the parameter is an arc length between the two waypoints or an arc extent between the two waypoints, wherein determining that the parameter associated with the ground track for the flight leg exceeds the predetermined threshold comprises:

determining, by the flight management system, that the arc length or the arc extent between the two waypoints associated with the ground track for the radius-to-fix flight leg exceeds the predetermined threshold.

10. The method of claim 1, wherein modifying, by the flight management system, the ground track for the flight leg to include the at least two spherical earth model path segments spanning from the first waypoint through the at least one anchor point to the second waypoint comprises:

modifying, by the flight management system, the ground track to be a smooth ground track for the flight leg to include the at least two spherical earth model path segments spanning from the first waypoint through the at least one anchor point to the second waypoint.

11. The method of claim 1, further comprising:

determining, by the flight management system, a lateral deviation of the ground track for the flight leg.

12. A flight management system, comprising:

a non-transitory processor-readable memory; and at least one processor coupled to the non-transitory processor-readable memory, the at least one processor configured to:

determine a ground track for a flight leg of an active flight plan based at least on a spherical earth model, the flight leg comprising two waypoints comprising a first waypoint and a second waypoint that are specified with an ellipsoidal earth model;

determine that a parameter associated with the ground track for the flight leg exceeds a predetermined threshold;

in response to a determination that the parameter associated with the ground track for the flight leg exceeds the predetermined threshold, insert at least one anchor point on a geodesic and between the two waypoints, the geodesic associated with the ellipsoidal earth model;

modify the ground track for the flight leg to include at least two spherical earth model path segments spanning from the first waypoint through the at least one anchor point to the second waypoint, each of the at least two spherical earth model path segments computed based at least on the spherical earth model, wherein modifying the ground track for the flight leg effects a course change to the ground track between the two waypoints of the flight leg such that an intended flight path is within specified thresholds; and output data associated with the modified ground track to the non-transitory processor-readable memory.

13. The flight management system of claim 12, wherein a modification to the ground track for the flight leg to include the at least two spherical earth model path segments improves computational efficiency of the flight management system by requiring fewer computational operations to compute the ground track than a computation of an ellipsoidal earth model ground track for the flight leg.

14. The flight management system of claim 12, wherein a path definition error is approximately zero at each of the at least one anchor points.

15. The flight management system of claim 14, wherein the at least one anchor point is at least two anchor points comprising a first anchor point and second anchor point, wherein a path definition error for a segment between the first anchor point and the second anchor point is greatest at approximately halfway between the first anchor point and the second anchor point.

16. The flight management system of claim 12, wherein the flight leg is a track-to-fix flight leg, the parameter is a segment length between the two waypoints, and the at least one processor is further configured to determine that the segment length between the two waypoints associated with the ground track for the track-to-fix flight leg exceeds the predetermined threshold.

17. The flight management system of claim 12, wherein the flight leg is a track-to-fix flight leg, the track-to-fix flight leg is a first track-to-fix flight leg, and the at least one processor is further configured to:

determine that a next flight leg is a second track-to-fix flight leg immediately following the first track-to-fix flight leg;

determine a transition arc between the first track-to-fix flight leg and the second track-to-fix flight leg; and insert an anchor point at a beginning of the transition arc.

18. The flight management system of claim 12, wherein the flight leg is a radius-to-fix flight leg, the parameter is an arc length between the two waypoints or an arc extent between the two waypoints, and the at least one processor is further configured to:

determine that the arc length or the arc extent between the two waypoints associated with the ground track for the radius-to-fix flight leg exceeds the predetermined threshold.

19. A system, comprising:

a non-transitory processor-readable memory; and at least one processor communicatively coupled to the non-transitory processor-readable memory, the at least one processor configured to:

determine a ground track for a flight leg of an active flight plan based at least on a spherical earth model, the flight leg comprising two waypoints comprising a first waypoint and a second waypoint that are specified with an ellipsoidal earth model;

determine that a parameter associated with the ground track for the flight leg exceeds a predetermined threshold;

in response to a determination that the parameter associated with the ground track for the flight leg exceeds the predetermined threshold, insert at least one anchor point on a geodesic and between the two waypoints, the geodesic associated with the ellipsoidal earth model;

modify the ground track for the flight leg to include at least two spherical earth model path segments spanning from the first waypoint through the at least one anchor point to the second waypoint, each of the at least two spherical earth model path segments computed based at least on the spherical earth model, wherein modifying the ground track for the flight leg effects a course change to the ground track between the two waypoints of the flight leg such that an intended flight path is within specified thresholds; and output data associated with the modified ground track to the non-transitory processor-readable memory.

20. The system of claim 19, wherein the at least one processor is implemented in an aircraft, wherein a modification to the ground track for the flight leg to include the at least two spherical earth model path segments improves computational efficiency of the at least one processor by requiring fewer computational operations to compute the ground track than a computation of an ellipsoidal earth model ground track for the flight leg.

* * * * *